US006705353B2

(12) United States Patent
Hotta et al.

(10) Patent No.: US 6,705,353 B2
(45) Date of Patent: Mar. 16, 2004

(54) WOVEN STRECTH FABRIC

(75) Inventors: Yoshiomi Hotta, Ishikawa (JP); Tomoko Takahashi, Osaka (JP); Kazuto Oue, Takatsuki (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/203,030

(22) PCT Filed: Feb. 2, 2001

(86) PCT No.: PCT/JP01/00773

§ 371 (c)(1),
(2), (4) Date: Mar. 12, 2003

(87) PCT Pub. No.: WO01/57297

PCT Pub. Date: Aug. 9, 2001

(65) Prior Publication Data

US 2003/0159749 A1 Aug. 28, 2003

(30) Foreign Application Priority Data

| | | |
|---|---|---|
| Feb. 4, 2000 | (JP) | 2000-027698 |
| Feb. 10, 2000 | (JP) | 2000-033140 |
| May 19, 2000 | (JP) | 2000-147979 |

(51) Int. Cl.[7] ..... D03D 15/08
(52) U.S. Cl. ..... 139/421; 139/426 R; 428/364
(58) Field of Search ..... 139/421, 426 R; 428/364

(56) References Cited

U.S. PATENT DOCUMENTS

| | | | | |
|---|---|---|---|---|
| 6,287,688 | B1 * | 9/2001 | Howell et al. | 428/364 |
| 6,316,101 | B2 * | 11/2001 | Kato et al. | 428/364 |
| 6,423,407 | B1 * | 7/2002 | Abe et al. | 428/364 |
| 6,503,623 | B1 * | 1/2003 | Oue et al. | 428/364 |

FOREIGN PATENT DOCUMENTS

| | | |
|---|---|---|
| JP | 1-162838 | 6/1989 |
| JP | 6-25930 | 2/1994 |
| JP | 9-78373 | 3/1997 |
| JP | 10-195732 | 7/1998 |
| JP | 11-93036 | 4/1999 |
| JP | 11-323696 | 11/1999 |
| JP | 2000-226753 | 8/2000 |

* cited by examiner

*Primary Examiner*—John J. Calvert
*Assistant Examiner*—Robert H. Muromoto, Jr.
(74) *Attorney, Agent, or Firm*—Finnegan, Henderson, Farabow, Garrett & Dunner, L.L.P.

(57) ABSTRACT

The present invention provides a stretchable woven fabric characterized in that the warp yarn and/or the weft yarn is prepared from a false-twisted yarn of a poly(trimethylene terephthalate) multifilamentary yarn, and that the false-twisted yarn is twisted with a twist factor of from 2,700 to 13,000 in the direction reverse to the false twisting direction. The woven fabric of the present invention is useful as a stretch material for sportswear, outerwear, and the like.

11 Claims, No Drawings

WOVEN STRECTH FABRIC

TECHNICAL FIELD

The present invention relates to a stretchable woven fabric in which a false-twisted yarn of a poly(trimethylene terephthalate) (hereinafter abbreviated to PTT) multifilamentary yarn is used.

BACKGROUND ART

As a sports boom has increased in recent years, the realization of a woven fabric, for sportswear, that has a flat surface feel similarly to a windbreaker, that gives a soft fitting feeling and an very comfortable feeling to the wearer, has good stretchability, and that is excellent in weathering resistance and wash-and-wear properties (W & W properties), has been strongly desired. Moreover, a highly stretchable woven fabric having the properties described above has recently been required in the field of outerwear in order to give a comfortable feeling to the wearer.

As a method of producing a highly stretchable woven fabric, there has been a method of obtaining a woven fabric having a relatively high stretch ratio by blending elastic fibers. Moreover, there is a method of using a polyester-based fiber excellent in an elongation recovery and suitable for a stretch material. For example, Japanese Unexamined Patent Publication (Kokai) No. 9-78373 proposes a polyester-based false-twisted yarn having a PTT as its principal component. However, the method of using an elastic fiber has the following difficulties: the tightening force is strong and, moreover, a costly double covering yarn must be used in order to suppress the formation of a crepe-liked surface; the resultant woven fabric has poor weathering resistance; the fabric shows poor dye-affinity, and the yield in dye finishing is low.

A polyester-based false-twisted yarn having a PTT as its principal component which yarn is disclosed in Japanese Unexamined Patent Publication (Kokai) No. 9-78373 is excellent in an elongation recovery and has a low Young's modulus in comparison with a poly(ethylene terephthalate) (hereinafter abbreviated to PET) yarn; as a result the yarn is characterized in that it is soft.

On the other hand, Japanese Unexamined Patent Publication (Kokai) No. 11-93031 discloses woven fabrics, as lining cloth formed from a false-twisted yarn of a PTT fiber, such as a plain weave fabric, a twill weave fabric and a satin weave fabric, that are excellent in surface smoothness and that show a stretch ratio of from 15 to 20%. However, when the woven fabrics are made to show a stretch ratio of 20% or more, the surface smoothness becomes poor as described in the patent publication. Moreover, the patent publication describes that additional twisting may be imparted to the yarn at a twist number of from 100 to 1,000 T/m for the purpose of improving the surface smoothness, and that the woven fabrics may be subjected to alkali reduction for the purpose of making them have a soft feeling.

Furthermore, Japanese Unexamined Patent Publication (Kokai) No. 11-93037 describes a woven fabric comprising a twisted yarn of a PTT fiber with a twist factor of from 0 to 4,000 as one of the warp or the weft yarn, and a twisted yarn of a PTT fiber with a twist factor of from 10,000 to 30,000 as the other yarn. Moreover, the patent publication describes that the woven fabric is optionally subjected to alkali reduction. However, the two patent publications do not describe at all the importance of the relationship between the twisting direction of the false twisting and that of the twisted yarn.

Japanese Unexamined Patent Publication (Kokai) No. 11-93016 describes a PTT fiber on which micropores are formed by alkali reduction and which is excellent in color developability.

DISCLOSURE OF THE INVENTION

An object of the present invention is to provide a woven fabric having one or at least two of the following properties: excellent surface flatness; a soft feel; high stretchability; a high elongation recovery; snagging resistance; an excellent wrinkle resistance; and an excellent comfortable feeling for the wearer.

In general, when the woven fabric is intended to have a high stretch ratio, the woven fabric surface shows a crepe-liked surface or a striped crepe-liked surface. The woven fabric must therefore be finished while the woven fabric is being held in a tensed state, in order to make the surface flat. As a result, only a fabric showing a low stretch ratio has heretofore been obtained, and the real situation has been that a woven fabric having a flat surface and showing a high stretch ratio has been unavailable.

That is, simultaneously imparting a stretchable function to the fabric and suppressing a crepe-liked surface signify simultaneously pursuing two mutually contradictory functions. It has been extremely difficult to make the two functions compatible.

The present inventors have completely investigated the relationship between a surface flatness and a stretch ratio of woven fabrics for which various polyester-based false-twisted yarns are used as warp yarns and/or weft yarns while the structure design, the weave design and the finish texturing conditions are being varied. As a result, the present inventors have discovered that a woven fabric excellent in stretchability while having surface flatness can be obtained only by using a false-twisted yarn of a PTT multifilamentary yarn showing high stretchability and a high elastic recovery as a warp yarn and/or a weft yarn, and combining a textured yarn design, a weave design and a finish texturing design that are most suitable. The present invention has thus been achieved.

That is, the present invention is as explained below.

1. A stretchable woven fabric characterized in that the warp yarn and/or the weft yarn is prepared from a false-twisted yarn of a poly(trimethylene terephthalate) multifilamentary yarn, and that the false-twisted yarn is twisted with a twist factor of from 2,700 to 13,000 in the direction reverse to the false twisting direction.

2. The stretchable woven fabric according to 1, wherein the stretch ratio of the woven fabric is from 15 to 50% in the warp and/or weft direction.

3. The stretchable woven fabric according to 1, wherein the stretch ratio of the woven fabric is greater than 20% and 50% or less in the warp and/or weft direction.

4. The stretchable woven fabric according to any one of 1 to 3, wherein the surface roughness ($R_a$) is from 10 to 30 $\mu$m.

5. The stretchable woven fabric according to any one of 1 to 4, wherein the filaments of the poly(trimethylene terephthalate) filamentary yarn have microcraters on the surfaces.

6. A stretchable woven fabric characterized in that the warp yarn and/or the weft yarn is prepared from a false-twisted yarn of a poly(trimethylene terephthalate) multifilamentary yarn, that the stretch ratio of the woven fabric is 15% or more in the warp and/or weft direction, and that the surface roughness ($R_a$) is from 10 to 30 $\mu$m.

7. The stretchable woven fabric according to 6, wherein the stretch ratio of the woven fabric is greater than 20% and 50% or less in the warp and/or weft direction.

8. The stretchable woven fabric according to any one of 1 to 7, wherein the weave texture of the woven fabric is a 2/2 weft ribbed weave, a 2/1 twill weave or a 2/2 twill weave.

9. A process for producing a stretchable woven fabric comprising the steps of: twisting a poly(trimethylene terephthalate) multifilamentary yarn prior to or subsequently to false twisting with a twist factor of from 2,700 to 13,000 in the direction reverse to the false twisting direction, whereby a textured yarn is obtained; weaving the textured yarn used as a warp yarn and/or a weft yarn; and subjecting the resultant woven fabric to alkali reduction.

10. The process for producing a stretchable woven fabric according to 9, wherein the alkali reduction ratio is from 4 to 15% by weight.

11. A process for producing a stretchable woven fabric comprising the steps of: false twisting a poly(trimethylene terephthalate) multifilamentary yarn; additional twisting is imparted to the false-twisted yarn in the direction reverse to the false twisting direction, whereby a textured yarn having a twist factor of additional twist of from 2,700 to 13,000 is obtained; and weaving the textured yarn as a warp yarn and/or a weft yarn so that the stretch ratio of the woven fabric is adjusted to from 15 to 50% in the warp and/or weft direction.

DETAILED DESCRIPTION OF THE INVENTION

In the present invention, a PTT fiber designates a fiber of a polyester having trimethylene terephthalate units as principal repeating ones, and contains trimethylene terephthalate units in an amount of about 50% by mole or more, preferably 70% by mole or more, more preferably 80% by mole or more, still more preferably 90% by mole or more. Accordingly, the PTT includes a poly(trimethylene terephthalate) containing, as third components, other acid components and/or glycol components in a total amount of about 50% by mole or less, preferably 30% by mole or less, more preferably 20% by mole or less, still more preferably 10% by mole or less.

A PTT is synthesized by combining terephthalic acid or a functional derivative thereof, and trimethylene glycol or a functional derivative of trimethylene glycol under suitable reaction conditions in the presence of a catalyst. In the course of the synthesis, a suitable one or two or more third components may be added to give a copolymerized polyester. Alternatively, a polyester other than a PTT such as a PET and a poly(butylene terephthalate), nylon and a PTT may be separately synthesized, blended, and composite spun (sheath-core, side-by-side, etc.).

As exemplified by Japanese Examined Patent Publication (Kokoku) No. 43-19108, Japanese Unexamined Patent Publication (Kokai) No. 11-189923, Japanese Unexamined Patent Publication (Kokai) No. 2000-239927, Japanese Unexamined Patent Publication (Kokai) No. 2000-256918, and the like, some of the composite spun yarns are prepared by composite spinning a first component that is a PTT, and a second component that is a polyester such as a PTT, a PET or a poly(butylene terephthalate), or nylon while the first and the second component are being arranged in parallel (in a side-by-side manner) or eccentrically (in an eccentric sheath-core manner). A combination of a PTT and a copolymerized PTT, or a combination of two types of PTTs different from each other in intrinsic viscosity is particularly preferred. Of these spun yarns, a composite spun yarn prepared, as exemplified by Japanese Unexamined Patent Publication (Kokai) No. 2000-239927, by spinning in a side-by-side manner two types of PTTs different from each other in intrinsic viscosity so that the PTT having a lower viscosity encloses the PTT having a higher viscosity (the bonded surface shape being curved) is particularly preferred because the yarn has both high stretchability and bulkiness.

Examples of the third component to be added include aliphatic dicarboxylic acids such as oxalic acid and adipic acid, alicyclic dicarboxylic acids such as cyclohexanedicarboxylic acid, aromatic dicarboxylic acids such as isophthalic acid and sodium sulfoisophthalic acid, aliphatic glycols such as ethylene glycol, 1,2-propylene glycol and tetramethylene glycol, alicyclic glycols such as cyclohexanedimethanol, aliphatic glycols containing an aromatic group such as 1,4-bis(β-hydroxyethoxy)benzene, polyether glycols such as poly(ethylene glycol) and poly(propylene glycol), aliphatic oxycarboxylic acids such as ω-oxycaproic acid, and aromatic oxycarboxylic acids such as p-oxybenzoic acid. Moreover, a compound (such as benzoic acid or glycerin) having one or three or more ester-forming functional groups may also be used as long as the resultant polymer is substantially linear.

In the present invention, the PTT fiber used in the present invention may further contain delustering agents such as titanium dioxide, stabilizing agents such as phosphoric acid, ultraviolet ray absorbers such as a hydroxybenzophenone derivative, nucleating agents such as talc, lubricants such as Aerosil, antioxidants such as a hindered phenol derivative, flame retardants, antistatic agents, pigments, fluorescent brighteners, infrared ray absorbers, defoaming agents, and the like.

For spinning the PTT fiber in the present invention, any of the following methods may be adopted: a method comprising spinning at a winding rate of about 1,500 m/min to give an undrawn yarn, and drawing and twisting the yarn by a-factor of from about 2 to 3.5; a direct drawing method (spin draw method) in which a spinning step and a drawing and twisting step are directly connected; and a high speed spinning method (spin take-up method) comprising winding at a rate of 5,000 m/min or more.

Furthermore, the shape of the fiber is multifilamentary, and the filament may be uniform, or thick and thin in the longitudinal direction. The cross-sectional shape of the filament may be round-shaped, triangle-shaped, L-shaped, T-shaped, Y-shaped, W-shaped, eight leaf-shaped, flat, polygon-shaped (e.g., dog bone-shaped), multi-leaf-shaped, hollow or indefinitely shaped.

There is no specific limitation on the size of the PTT multifilamentary yarn used in the present invention. The size is, for example, from 34 to 167 dtex, preferably from 56 to 110 dtex. The single filament size is preferably from 0.1 dtex or more in view of suppressing a yarn breakage during false twisting, preferably 5.6 dtex or less in view of the feel.

The strength of the PTT multifilamentary raw yarn used in the present invention is preferably 2.6 cN/dtex or more in view of the strength of the false-twisted yarn, more preferably from 2.6 to 5.0 cN/dtex. The elongation is preferably 35% or more in view of decreasing the yarn breakage during false twisting, more preferably from 35 to 60%. The elastic modulus is preferably 26.5 cN/dtex or less in view of the softness of the fabric obtained, more preferably from 17.6 to 26.5 cN/dtex. The elastic recovery at 10% elongation is preferably 70% or more in view of the recovery from elongation when the raw yarn is used for a woven fabric, more preferably from 80 to 100%.

A false-twisted yarn prepared by false twisting such a PTT multifilamentary raw yarn is used as the warp and/or the weft yarn of the woven fabric in the present invention.

Any of the false twisting methods such as a pin type, a friction type, a nip belt type and an air twisting type false twisting method may be used as a false twisting one for obtaining the false-twisted yarn. However, a pin type false twisting method is preferred because a more uniform crimped state can be easily obtained by the method. Moreover, the so-called one-heater false-twisted yarn (nonset type) is preferred to the so-called two-heater false-twisted yarn (set type) because a woven fabric having a higher stretch ratio in addition to an extremely high stretch elongation (e.g., from 300 to 450%) and a high stretch modulus (e.g., 85% or more) can be obtained.

As to the physical properties of such a false-twisted yarn, the elastic recovery at 10% elongation is preferably 70% or more in view of the recovery from elongation when used for a woven fabric, more preferably from 80 to 100%.

In order to obtain a false-twisted yarn having an elastic recovery of 70% or more, it is preferred to set the thermal fixing temperature at temperature from 150° C. or more to 190° C. or less during false twisting. When the thermal fixing temperature is in the above range, the false-twisted yarn shows neither yarn breakage nor lowering of the elastic recovery, and a sufficient elongation recovery as a stretch material.

Furthermore, the false twist number T1 can be calculated from the following formula:

$$T1(T/m)=K1/\{\text{size (dtex) of the raw yarn}\}^{1/2}$$

wherein K1 is a twist factor of false twist. K1 is preferably from 23,000 to 36,000, more preferably from 27,000 to 34,000.

The false-twisted yarn of a PTT multifilamentary yarn forming the woven fabric of the present invention can be used either in a state of a non-twisted false-twisted yarn, or in a state of a reverse twisted false-twisted yarn with additional twist in the direction reverse to the false twisting direction, or in a state of a false-twisted yarn of pre-twisted yarn that is prepared by false twisting a pre-twisted yarn in the direction reverse to the twisting direction. A yarn even in the state of a non-twisted false-twisted yarn can be used by selecting the most suitable combination of a weave texture, a density and a relaxation method. However, when the yarn is used in a state of reverse twisted false-twisted yarn with additional twist or reverse false-twisted yarn with additional false-twisting in the direction reverse to the twisting direction, the shapes of crimps of the false-twisted yarn can be made fine and well-balanced; moreover, the yarn can take a spiral core structure extremely effective for improving the elongation recovery of the false-twisted yarn and fabric. Accordingly, the yarn in such a state is more preferred.

Because the spiral core structure produces a spring effect, the yarn can obtain high stretchability and stretch back properties. Moreover, a woven fabric prepared therefrom easily obtains surface flatness. Furthermore, because of actual twist, the false-twisted yarn with additional twist and the false-twisted yarn of pre-twisted yarn also preferably has the effects of improving the snagging resistance.

Particularly high stretchability can be imparted to the woven fabric of a false-twisted yarn with additional twist by making the twisting direction reverse to the false twisting direction. When the twisting directions are made equal, the fabric surface becomes more flat by increasing the additional twist number more; however, the stretchability conversely tends to lower. The additional twist number T2 is calculated from the following formula:

$$T2(T/m)=K2/\{\text{size (dtex) of the raw yarn}\}^{1/2}$$

wherein K2 is a twist factor of additional twist. K2 is preferably from 2,700 to 13,000, more preferably from 3,000 to 10,000.

When the twist factor K2 is 2,700 or more, the surface of the woven fabric thus obtained has no striped crepe-liked surface, and shows an insignificant crepe-like effect. The woven fabric has surface flatness, and shows high stretchability. Furthermore, when the twist factor K2 is 13,000 or less, the woven fabric of hard twisted yarn is not obtained, and the fabric obtained shows little crepe-like effect on the surface, has high stretchability and has a soft feel.

Furthermore, when additional twisting is imparted to the false-twisted yarn, it is preferred for the yarn to be subjected to twist stop at temperature of from 70 to 80° C. for a time of from 30 to 60 minutes by steam setting or the like procedure.

On the other hand, a woven fabric having a higher stretch ratio can be obtained from a false-twisted yarn of pre-twisted yarn. A preferred false twisting condition is as follows: the thermal fixing temperature during false twisting is preferably from 150° C. or more to 190° C. or less. When the thermal fixing temperature is 190° C. or less, little yarn breakage takes place. When it is 150° C. or more, the woven fabric thus obtained shows substantially no lowering of the elongation recovery, and maintains a sufficient elongation recovery as a stretch material.

The false-twist number T3 can be calculated from the following formula:

$$T3(T/m)=K3/\{\text{size (dtex) of the raw yarn}\}^{1/2}+T4$$

wherein K3 is a twist factor of the false-twist number. K3 is preferably from 21,000 to 33,000, more preferably from 25,000 to 32,000.

In order for the woven fabric to manifest high stretchability, it is particularly preferred to make the twisting direction of a false-twisted yarn of pre-twisted yarn reverse to that of false twisting. When the two directions are made identical, the woven fabric tends to manifest a crepe-liked surface or low stretchability.

The pre-twist number T4 can be calculated from the following formula:

$$T4(T/m)=K4/\{\text{size (dtex) of the raw yarn}\}^{1/2}$$

wherein K4 is a twist factor of pre-twist. K4 is preferably from 2,700 to 13,000, more preferably from 4,500 to 12,000.

When the twist factor K4 is 2,700 or more, the woven fabric thus obtained has a relatively flat surface, and shows excellent stretchability and elongation recovery. Moreover, when the twist factor K4 is 13,000 or less, the woven fabric thus obtained shows no hard-twisted yarn effect, has an insignificant crepe-liked effect on the surface, excellent stretchability, and has a soft feel.

A pre-twisted yarn prepared by pre-twisting a yarn in advance prior to false twisting, in the direction reverse to the false twisting direction, is preferably subjected to a twist stop at temperature of from 70 to 80° C. for a time of from 30 to 60 minutes by a procedure such as steam setting. The pre-twisted yarn then shows excellent processability in the subsequent false twisting.

In addition, a woven fabric for which the reverse false-twisted yarn with additional twist or the false-twisted yarn of pre-twisted yarn is used has a feel of a twisted yarn, and is highly suitable for outerwear applications.

Furthermore, a warp-stretched woven fabric having stretchability in the warp direction or a so-called 2-way stretched woven fabric having stretchability in the two directions, the warp and weft directions, provides low contact pressure during wearing. The wearer therefore hardly gets tired even when it is worn for a long period of time. Moreover, the woven fabric hardly causes problems such as formation of deformed knee portions and deformed elbow portions because the elongation recovery is excellent. Furthermore, when pants (trousers), skirts, or the like, prepared therefrom are worn, cross-wise wrinkles formed in the portion of reverse side of the knee or in the hip portion, namely, so-called wrinkles of wearing are hardly formed. Accordingly, the woven fabric is extremely significantly suitable for goods such as pants and skirts, uniforms, and the like.

The reverse twisted false-twisted yarn can be easily obtained by preparing a false-twisted yarn in advance, and additional twisting is imparted to the false-twisted yarn with a twist factor of from 2,700 to 13,000 according to the desired stretch ratio of a woven fabric. The reverse twisting system of a false-twisted yarn is therefore characterized in that the system is industrially advantageous in comparison with the reverse pre-twisting system.

In the present invention, the strength of a yarn that is obtained by twisting a false-twisted yarn of a PTT multifilamentary yarn in the reverse direction is preferably 2.0 cN/dtex or more in view of the tenacity of the woven fabric prepared therefrom, more preferably from 2.5 to 5.0 cN/dtex. The elongation is preferably 35% or more in view of the stretchability of the woven fabric prepared therefrom, more preferably from 35 to 70%. The elastic modulus is preferably 17.6 cN/dtex or less in view of the softness of the fabric, more preferably from 13.2 to 17.6 cN/dtex. The elastic recovery at 10% elongation is preferably 70% or more in view of the recovery from elongation during the use of the woven fabric prepared therefrom, more preferably from 80 to 100%.

The woven fabric of the present invention preferably shows a stretch ratio in the warp and/or weft direction of 15% or more, more preferably greater than 20% and 50% or less. More specifically, the stretch ratio in the warp direction is preferably from 15 to 50%, more preferably from greater than 20% to 50%; the one in the weft direction is preferably from 15 to 65%, more preferably from greater than 20% to 50%. When the stretch ratio is in the above range, the woven fabric of the invention can show smooth adaptability to a local and instantaneous body movement in the field of sportswear that is the principal application of the fabric. Moreover, when the stretch ratio in the warp direction exceeds 50%, or the stretch ratio in the weft ratio exceeds 65%, the fabric sometimes shows a slight poor recovery or a large residual shrinkage. Furthermore, in the field of outerwear, the woven fabric provides a significantly excellent comfortable feeling to the wearer when the stretch ratio is in the above range. Moreover, the woven fabric shows an elongation recovery in the warp and/or weft direction at 4.9 N/cm stress of preferably 70% or more, particularly preferably 80% or more.

In addition to the above stretch ratio, in order to provide the flat outward appearance that is one important quality of sportswear, and the like, the woven fabric has a surface roughness ($R_a$) of preferably from 10 to 30 $\mu$m, more preferably from 10 to 25 $\mu$m, still more preferably from 10 to 20 $\mu$m.

It cannot be concluded that the woven fabric becomes more excellent when the fabric has a smaller surface roughness ($R_a$). When the surface roughness ($R_a$) is less than 10 $\mu$m, the surface state becomes too flat, and the fabric unpreferably manifests an abnormally strong film sheet-like gloss (termed glaringly gloss). Moreover, because the fabric has substantially no surface unevenness, the degree of close fitting to the skin increases, and the degree of separation from the skin lowers, resulting in deterioration of the wearing feeling. That is, when there is the possibility that the fabric is directly contacted with the skin, the fabric preferably has fine unevenness.

In the present invention, the lower limit value of $R_a$ is preferably 10 $\mu$m or more. When the lower limit value exceeds 30 $\mu$m, the unevenness of the woven fabric becomes too large. As a result, the fabric tends to show insufficient suitability particularly for sportswear applications.

In the present invention, when stretchability is to be imparted to the warp direction alone, a false-twisted yarn of a PTT multifilamentary yarn should be used as a warp yarn. When stretchability is to be imparted to the weft direction alone, a false-twisted yarn of a PTT multifilamentary yarn should be used as a weft yarn. When stretchability is to be imparted to the warp and weft directions (2-way stretch woven fabric), a false-twisted yarn of a PTT multifilamentary yarn should be used as a warp yarn and a weft yarn. The false-twisted yarn can be optionally used according to the applications.

The blending ratio of a false-twisted yarn of a PTT multifilamentary yarn in the woven fabric of the present invention is preferably from 20 to 100% by weight, more preferably from 30 to 100% by weight, particularly preferably from 50 to 100% by weight. When the blending ratio is in the above range, the woven fabric can fully display its characteristics such as a stretch function and a soft feel.

There is no specific limitation on the fiber to be blended with such a false-twisted yarn, and a filamentary yarn and a short fiber may be used. Any of the following fibers may be blended by a procedure such as mixed weaving, stable fiber blending (CSIRO span, CSIRO fil., etc.), filament mingling (shrinkage-differenced mingled yarns with a high shrinkage yarn), union twisting, composite false twisting (elongation-differenced false twisting, etc.) and 2-feed air jet texturing: polyester-based fibers such as PTT fibers and PET fibers; polyamide fibers such as nylon 6 and nylon 66; synthetic fibers such as acetate fibers; cellulose-based fibers such as cuprammonium fibers and rayon fibers; natural fibers represented by cotton, hemp and wool; and the like fibers. Moreover, the shape of the yarn may be a raw yarn or a bulky textured yarn represented by a false-twisted yarn, and any of the conventionally known yarns of various shapes may be used.

The blending form during mixed weaving such various fibers that are used as warp and/or weft yarns may be, for example, alternate feeding of one or two yarns, or irregular alternate feeding of at least three yarns. However, use of one of the above yarns as a warp or weft yarn, or alternate feeding of the one yarn is preferred for the purpose of obtaining a woven fabric having a less unpreferably shaped surface.

In the present invention, the weave texture of the woven fabric may be a plain weave, a twill weave, a stain weave, or various modified weaves derived from the above ones. In the field of sportswear, or the like, a relatively basic weave, such as a plain weave, a 2/2 weft ribbed weave (weft ribbed weave with two warp ends) and a twill weave, is generally often desired. Moreover, the fabric is desired to have a high snagging resistance. As a result, a plain weave, a 2/2 weft ribbed weave that is one derivative of the plain weave excellent in a soft feel and a snagging resistance while having a surface state similar to the plain weave, a simple twill weave such as a 2/1 twill weave or a 2/2 twill weave, and the like are preferred because the fabric has a suitable weave strength (restraining force in the texture).

In particular, because a 2/2 weft ribbed weave has a weave texture in which the warp yarns of a plain weave are each expanded by a factor of 2 in the width direction alone of the fabric, the bending frequency of the warp yarns is the same as that of a plain weave, and the bending frequency of the weft yarn lone is greatly decreased (number of interlacing of warp and weft yarns decreasing by a factor of ½ in the width direction) of the woven fabric. As a result, the restraining force of the weft yarn is decreased, and the degree of freedom of the weft yarn is greatly increased. Consequently, a gray fabric in which such a weave texture is employed can sufficiently manifest a width-shrinkage capacity without manifesting a crepe-liked surface during relaxation treatment. Therefore, a woven fabric showing a high stretch ratio and a high elongation recovery can be obtained. Moreover, when such a weave texture is used, the adjacent warp yarn width can be expanded twice in the width direction without increasing the thickness of the woven fabric; therefore, a soft feel can be ensured. Furthermore, the woven fabric can be made light, and at the same time the effect of increasing the resistance to scratching and friction (snagging resistance) can be obtained because the number of interlacings of the warp and weft yarns per unit area is large in comparison with a satin weave.

The warp yarn density of a fabric with a 2/2 weft ribbed weave using the same warp yarns and weft yarns is preferably from 1.2 to 1.6 times, more preferably from 1.3 to 1.5 times that of the plain weave in view of ensuring the stretch ratio in the weft direction.

When a fabric is to be woven using a 2/2 weft ribbed weave, methods of threading yarns through a heald include the following two methods: a method of threading two warp yarns into a male hole; and a method of arranged in two rows by threading a single warp yarn into a male hole. Although both methods can be used, the latter method is preferred in view of avoiding the occurrence of yarns crossed over. Moreover, when a method wherein the number of heald frames is increased to about eight, and warps that make the same shedding motion while maintaining an adjacent relation are made remote from each other as much as possible (e.g., three heald frames are skipped in the course) are employed, the yarn separation of warp yarns that make the same shedding motion is greatly improved. Accordingly, application of the method tends to achieve the effects of greatly improving the weavability and warp quality.

Methods of threading yarns through a reed include the following two methods: a method of drawing two ends of warp under the same shedding motion into a single dent of the reed; and a method of drawing two ends of warp under different shedding motions into a single dent of the reed. Both methods can be employed. Of the two methods, the former method is preferred because the shedding state is improved due to the reduction of friction between the warp yarns caused by the shedding motion within the same reed so that the weavability and the warp quality can be more easily ensured. In this case, a loom that feeds a weft yarn into the warp shedding with a fluid and that is represented by an air jet loom, a water jet loom, or the like is preferred because the effects of improving the stability of feeding a weft yarn become significant. Moreover, a rapier loom, a gripper loom, a fly shuttle loom, and the like are preferred for the same reason.

A fluid jet weaving machine represented by an air jet loom, a water jet loom, and the like, a rapier loom, a gripper loom, a fly-shuttle loom, etc. can be used as a weaving machine for weaving the stretchable woven fabric of the invention. However, a fluid jet weaving machine such as an air jet loom and a water jet loom that can feed a weft yarn under a low tension while a decreased load is applied thereto is preferred in view of suppressing a variation in the stretch ratio in the width direction of the fabric in addition to making the fabric display the stretchability in the weft direction as much as possible. Of these looms, an air jet loom is particularly appropriate.

When the woven fabric of the present invention is to be prepared, the warp yarn density and weft yarn density in the gray fabric step are preferably adjusted suitably by dye finishing so that a stretch ratio of 15% or more, particularly a stretch ratio exceeding 20% can be obtained though the densities differ depending on the size of the fiber to be used. For example, when a gray fabric of a 2/2 weft ribbed weave is to be prepared from a PTT multifilamentary raw yarn of 56 dtex/24 f as a warp yarn and a false twisted yarn of a PTT multifilamentary yarn of 84 dtex/24 f as a weft yarn, a proper warp yarn density is preferably from 130 to 160 ends/2.54 cm, more preferably from 140 to 150 ends/2.54 cm. Moreover, a proper weft yarn density is preferably from 80 to 105 picks/2.54 cm, more preferably from 85 to 90 picks/2.54 cm. However, the yarn densities are not restricted to the ranges mentioned above in the present invention.

In order to use the woven fabric of the invention as commercial goods for various purposes and widen the applications, the woven fabric is generally desired to have a relatively basic weave such as a plain weave, a twill weave and a satin weave that are three foundation weaves of a woven fabric.

In the present invention, a false-twisted yarn of a PTT multifilamentary yarn that has a significantly high relaxation shrinkage capacity is used as a warp yarn and/or a weft yarn. As a result, for a plain weave that has the highest number of interlacing per unit area of warp yarns and weft yarns, the degree of freedom of yarns within the woven fabric weave is extremely limited because the restraining force of the texture is drastically high. The yarns in the weave therefore hardly slide, and the fabric shrinks in the width and warp directions while the weave points are being fixed so that crepe-liked surface tends to be manifested. In order to decrease the crepe-liked surface, it becomes essential to tent or pull the fabric in the warp direction, and the fabric tends to show a lowered stretch ratio.

When a plain weave, that is the simplest and firmest weave texture among the weave textures, is to be used, a woven fabric alone for which a false-twisted yarn having a specific structure such as a reverse twisted false-twisted yarn of a PTT multifilamentary yarn with additional twist in the direction reverse to the false twisting direction or a false-twisted yarn of pre-twisted yarn thereof is used can show both surface flatness and high stretchability.

Because the number of interlacings per unit area of warp and weft yarns for a twill weave is small in comparison with a plain weave, the degree of freedom of yarns in the woven fabric increases in comparison with a plain weave. As a result, the reduction in width and the shrinkage in the warp direction during relaxation treatment are improved, and the stretch ratio also tends to be improved. Moreover, the surface flatness of the woven fabric also tends to be improved. Therefore, for a twill weave, in addition to such a false-twisted yarn having the above specific texture as a reverse twisted false-twisted yarn with additional twist and a false-twisted yarn of pre-twisted yarn, a non-twisted false-twisted yarn may also be applied.

For a satin weave, because the number of interlacing of warp and weft yarns per unit area is still smaller than those of a plain weave and a twill weave, the degree of freedom of yarns in the woven fabric becomes largest. As a result, reduction in width and shrinkage in the warp direction during relaxation treatment are improved, and the stretch ratio also tends to be improved. However, because the densities of the warp and weft yarns must be made largest in view of preventing slip of the weave texture, there are difficulties in making the woven fabric light. Furthermore, because the warp yarns most often show floating, the problem that the snagging resistance is deteriorated, in comparison with a plain weave, a 2/2 weft ribbed weave and several twill weaves, tends to arise.

The arrangement of warp yarns and/or weft yarns may be either a Z/Z arrangement (arrangement of Z-twisted yarns alone), an S/S arrangement (arrangement of S-twisted yarns alone), or an S/Z alternate arrangement (alternate feeding of one or two yarns, or alternate feeding of yarns as many as 3 or more of an S-twisted yarn and a Z-twisted yarn). However, an S/Z alternate arrangement (alternate feeding of one yarn) is preferred because the torque of the fabric is decreased to form a flat woven fabric without a fabric curl.

The texturing method that makes the woven fabric of the present invention manifest a stretch ratio as high as 15% or more while maintaining the surface flatness, or a stretch ratio as high as greater than 20% is a method comprising relaxing the gray fabric to realize reduction in width and warp shrinkage, dyeing the fabric, and final setting the dyed fabric (the fabric being also finished).

It is preferred that the woven fabric of the present invention be simultaneously scoured and relaxed (reduction in width and/or working in in the warp direction) in water or an aqueous solution at temperature from 90 to 130° C. containing a surfactant and an alkaline material with a relaxer of a liquid surface vibration type, a submerged vibration type, a submerged suspension type, a jet type, a liquid flow type, or the like type.

Of the relaxers mentioned above, a boil-off machine of a liquid vibration type (manufactured by Hinecken or Metzeler), a softening machine of a jet type (manufactured by Nissen Co., Ltd.), a jet dyeing machine (manufactured by Nichihan Seisakusho K.K.), and the like are preferably used. However, it is particularly preferred to use a U-shaped softening machine that can softly crumple the gray fabric with a pressurized jet water flow while working in the fabric with an open width in the warp direction thereof, in view of the manifestation of the surface flatness and high stretchability.

The U-shaped softening machine is particularly preferably adopted when a woven fabric for which a false-twisted yarn of a non-twisted PTT multifilamentary yarn is used is to be treated. The treatment temperature is preferably from 80 to 105° C., more preferably from 90 to 100° C. It is then also effective to subsequently make the woven fabric follow an overfeed dry heat relaxation step, with an open width, called a shrink surfer. The temperature is preferably from 140 to 170° C., more preferably from 150 to 170° C. Moreover, it is preferred to subject the woven fabric to intermediate setting, prior to dyeing, for the purpose of making the fabric attain a surface flatness. The temperature is preferably from 150 to 170° C. When the woven fabric is treated in the above temperature range, the fabric shows no lowering of stretchability because the fabric is well set and because the textured yarn maintains its crimpability.

There is no specific limitation on the dyeing apparatus, and a jet-dyeing machine, etc. can be employed. There is no specific limitation on finishing agents. Such agents ordinarily used as softening agents, water repellents and antistatic agents may be used. The final setting temperature is preferably in a range from 150 to 170° C., is the same as the intermediate setting temperature.

In addition, when the woven fabric is to be made to have stretchability in the warp direction, the fabric is preferably worked in the warp direction. Moreover, in order to suppress the residual shrinkage in the warp direction, the fabric is preferably kept at a low tension until the end of the final step.

Calendering the woven fabric is one of the effective procedures for increasing the surface flatness, and the procedure should be suitably selected according to the object. It has been found that calendering the woven fabric under proper conditions can improve the flatness without lowering the stretchability. When the fabric is to be calendered, a combination of roll materials for the calendering machine, a calendering temperature, a calendering pressure and a calendering time are desirably determined by taking the balance between the effects of improving the flatness and the effects of suppressing the surface gloss. Of these factors, the calendering temperature that is particularly influential is preferably from 130 to 170° C., more preferably from 140 to 170° C., still more preferably from 150 to 170° C. When the temperature is 130° C. or more, the aimed crushing effects can be achieved. When the temperature is 170° C. or lower, the fabric does not become film-like, has a soft feel, and produces no defects such as lowered permeability and abnormal gloss. It is also effective to calender the woven fabric twice in a relatively low temperature region in the above temperature range. Because calendering also has the effect of improving the water resistance of the textured fabric, it can have an auxiliary role in achieving the object of the present invention.

The woven fabric for which a false-twisted yarn of a PTT multifilamentary yarn is used as the warp yarn and/or weft yarn has a significantly flexible feel in comparison with the woven fabric for which a false-twisted yarn of a conventional PET multifilamentary yarn is used. However, because a false-twisted yarn is often utilized as a twisted yarn to enhance the designability and make the fabric have an excellent outward appearance when the fabric is used as an outerwear material for men and women, the fabric tends to lose the flexible feel the PTT fiber itself has. Moreover, the density of the woven fabric is often increased in order to make the fabric have a thick feel and a high-grade touch. As a result, the feel becomes stiff to a certain degree, and sometimes the fabric cannot attain a stretch ratio as high as 15% or more when the fabric is merely finished by procedures as explained above. In such cases, alkali reduction of the fabric is effective.

When a fabric formed from a false-twisted yarn of a PET multifilamentary yarn is subjected to alkali reduction in order to improve the feel, the effects of improving the feel of the fabric flexible can often be obtained only by a reduction of 15% by weight or more, in the usual cases, or by a reduction close to 40% by weight in many cases.

In contrast to the above fabric, when a fabric for which a false twisted yarn of a PTT multifilamentary yarn is used is subjected to alkali reduction, the fabric is extremely significantly made to have a flexible feel with a relatively low reduction, and displays the effects of improving the stretchability. When the reduction is larger, the feel becomes more flexible and supple, and the degree of improving the stretchability becomes larger. When the fabric is subjected to alkali reduction, the fabric becomes wrinkle-resistant, and has a resilient feel. The reduction is preferably from 2 to 20% by weight, more preferably from 4 to 15% by weight, particularly preferably from 6 to 9% by weight. When the reduction is in the above range, the fabric shows sufficient alkali reduction effects, no lowering of a tear strength, etc., and has an excellent resilient feel. In addition, the reduction herein designates a proportion (%) of a mass reduced by alkali reduction to a mass of a PTT multifilamentary yarn in the woven fabric prior to alkali reduction.

The cause of significant improvements in the flexible feel, stretchability and wrinkle resistance even with a slight reduction is thought to be as explained below.

Alkali reduction of a woven fabric thins the yarns, and gaps are formed in interlacing points of the warp yarns and weft yarns and among the multifilaments forming the warp and weft yarns. As a result, friction among yarns is decreased, and each yarn becomes easily movable so that the fabric is made flexible. Although the PTT fiber itself has extremely high flexibility, friction among the yarns is high in comparison with the PET fiber. As a result, a fabric for which a twisted yarn is used, or which has a high density and many interlacing points cannot be made to have a flexible feel due to the friction. When the fabric is subjected to alkali reduction to form slight gaps in the interlacing points of the warp and weft yarns of the fabric, friction between the yarns is decreased. As a result, the fabric has an extremely significantly flexible feel. Moreover, a decrease in the friction among yarns makes each yarn movable. Consequently, the improvements in the stretchability and wrinkle resistance are also achieved.

Because an ordinary PET fiber itself has a high rigidity, flexibility cannot be imparted to the fiber by such a minor modification as formation of slight gaps in interlacing points of warp yarns and weft yarns. The fiber comes to have a soft feel only after thinning the yarns by subjecting them to reduction with a high reduction ratio. Moreover, alkali reduction of an ordinary PET fiber neither substantially improves the stretchability of the fiber, nor increases the wrinkle resistance. Furthermore, when a fabric formed from a PET fiber is subjected to reduction with a high reduction ratio, for the purpose of making the fabric have a flexible feel, the fabric surely comes to have a flexible feel. However, the tenacity of the yarns is lowered, and the yarns tend to shift because gaps are formed among the warp yarns and the weft yarns. As a result, the fabric often produces problems such as weave shifts and stitch shifts.

However, in the present invention, because the fabric can be made to have a flexible feel and show an improvement in the stretchability with a relatively low reduction ratio, such problems as mentioned above do not arise, and a fabric having extremely excellent physical properties can be obtained.

When the woven fabric of the present invention is subjected to alkali reduction, microcraters (micropores) are produced on the surface of the PTT filaments. The microcraters increase in number as the reduction ratio increases, and the size also tends to increase. When each filament has at least 20 microcraters, the fabric is defined as being subjected to alkali reduction (A measurement of microcraters is described later). Such microcraters are estimated to be formed due to the dissolution of fine particles of a delustering agent such as titanium oxide near the filament surface. When the microcraters are preferably 50 or more, the fabric has a flexible feel, and shows significant improvements in the stretch ratio and wrinkle resistance.

As explained above, the blending ratio of the false-twisted yarn of a PTT multifilamentary yarn is preferably from 20 to 100% by weight in the woven fabric of the present invention. However, there is no specific limitation on fibers to be blended when alkali reduction is conducted. The fibers may be either filamentary yarns or short fibers as long as the fibers are alkali-resistant. For example, fibers to be blended include the following fibers: polyester-based fibers such as PTT fibers and PET fibers; polyamide-based fibers such as nylon 6 and nylon 66; cotton; hemp; and rayon. However, because rayon is deteriorated with alkali at a high concentration, attention must be particularly paid to the concentration of alkali during alkali reduction when rayon is blended. The shape of fibers to be blended may be either a raw yarn or a bulky textured yarn represented by a false-twisted yarn. Moreover, for example, alternate feeding of one or two yarns, or alternate modified feeding of at least three yarns in conventionally known various woven fabrics may be employed; however, use of one of the above yarns as a warp yarn or a weft yarn alone is preferred.

The fabric is desirably pretreated prior to alkali reduction in the following manner. The fabric is desized, scoured, bleached in some cases, and preheat set. These steps are important for achieving uniform reduction.

The alkali reduction system may be the same as any of the conventional ones. Any of the following systems may be employed: a batch system such as a scouring-in loop system, a jigger system, a wince system and a liquid jet system; a continuous system such as a pad steam system and a pad dry system; and a semi-continuous system such as a pad roll system and a pad cold batch system. A fabric is subjected to alkali reduction by the following systems preferably in the following temperature ranges: temperatures from 95 to 98° C. (at normal pressure) for the batch system; steam temperatures from 100 to 105° C. for the pad steam system; dry heat temperatures from 120 to 160° C. for the pad dry system; temperatures from 70 to 90° C. for the pad roll system; and temperatures from 30 to 40° C. for the pad cold batch system. However, the temperature ranges are not restricted to those mentioned above. The most suitable conditions for alkali reduction should be selected for each fabric so that an aimed reduction ratio can be obtained.

Potassium hydroxide, lithium hydroxide, sodium hydroxide, or the like is effective as the alkali agent to be used for the alkali reduction. A concentration of an alkali agent to be used in each system is preferably on the high side with respect to the concentration used in an ordinary PET fiber.

Because a PTT fiber has a high alkali hydrolysis resistance in comparison with a PET fiber, the PTT fiber shows an alkali hydrolysis rate as slow as ⅓ of the that of the PET fiber. Therefore, addition of a promoter such as a quaternary ammonium salt is preferred when a batch-wise alkali reduction is conducted. Addition of an anion activating agent such as an alkyl phosphate as a penetrant is preferred when continuous or semi-continuous alkali reduction is conducted. It is preferred to increase the alkali concentration, raise the treatment temperature, or take a similar step for any of the above alkali reduction procedures, in order to increase the alkali reduction rate. Any commercially available promoter and penetrant may be used, and there is no specific limitation on the addition amounts. Alkali reduction conditions such as a reduction procedure, a reduction temperature and a reduction time, and addition amounts of promoters, etc. should be adjusted so that the aimed reduction ratio of each fabric can be achieved.

When chemicals used for alkali reduction or decomposition products, etc. produced by alkali reduction remain, such materials often influence the subsequent processing. For example, many of the dispersion dyes cause hydrolysis and reduction decomposition when high temperature treatment is conducted in an alkaline state, and significantly hinder the dye-affinity and color developability. Moreover, retention of a reduction promoter causes troubles such as yellowing of the fabric, a shade change of a dye and formation of dye specks. Retention of decomposition products causes conversion of the dye into tar and contamination of the can body, and moreover deteriorates the feel of the woven fabric. Accordingly, the residual materials are preferably removed by sufficient washing after reduction treatment. For example, the fabric is first washed with hot water so that decomposition products are removed, neutralized with an acid, and washed with water. Because a part of the decomposition products is sparingly soluble in cold water, it is effective to adequately wash the fabric with alkaline hot water. Moreover, when a reduction promoter is used, the fabric is preferably washed with an anion activating agent. Although the washing procedure is not restricted to those mentioned above, it is important that the fabric be sufficiently washed so that residual materials are removed as completely as possible.

The present invention will be more specifically explained below by making reference to examples, and the like. However, the present invention is in no way restricted thereto.

In addition, the measurement methods, evaluation methods, and the like are as explained below.

(1) Reduced Viscosity ($\eta_{sp}/c$)

A polymer is dissolved in o-chlorophenol at 90° C. at a concentration of 1 g/dl. The solution thus obtained is then placed in an Ostwald's viscometer, and a measurement is made at 35° C. The viscosity is calculated from the following formula:

$$\eta_{sp}/c=(T/T_0-1)/c$$

wherein T is a drop time (sec) of the sample solution, $T_0$ is a drop time (sec) of the solvent, and c is a concentration (g/dl) of the solution.

(2) Number of Microcraters

The surface of a woven fabric is scanned with a scanning electron microscope, and photographs each having a size of 8.5 cm×11.5 cm are taken at a magnification of 1,200. The yarn surface is photographed so that gaps are not produced in each photograph. The surface of the woven fabric is thus randomly photographed at 10 sites to give 10 photographs.

A pore having a length of from 1 to 6 μm on a single filament in the longitudinal direction of the yarn and a width of from 0.4 to 3 μm in the diameter direction of the filament is defined as a microcrater. The total number of the microcraters in the above 10 photographs is counted, and the number of microcraters is obtained by dividing the total number by 10.

(3) Stretch Ratio and Elongation Recovery at 4.9 N/cm Stress of a Woven Fabric

Using a tensile testing machine manufactured by Shimazu Corporation, a sample attached to the testing machine with a grip width of 2 cm and a grip-to-grip distance of 10 cm is elongated at a tensile rate of 10 cm/min in the warp or weft direction, and shrunk at the same rate to give a stress-strain curve. The elongation (%) at 4.9 cN/cm stress in the curve is defined as a stretch ratio.

The elongation recovery (%) is obtained from the following formula:

$$\text{elongation recovery (\%)}=[(10-A)/10]\times 100$$

wherein A is a residual elongation that is an elongation when the stress becomes zero during shrinkage.

(4) Surface Roughness ($R_a$: Average Roughness) of a Woven Fabric

A laser reflection displacement gauge (trade name of LC-2450, manufactured by Keyence Corporation) is mounted on a three dimensional shape determination apparatus (stage: LMS-3D 500 XY (H), controller: MINI-12P, manufactured by Sigma Koki Co., Ltd.). A woven fabric sample, 10 cm×10 cm, is allowed to stand still on the stage, and the sample is scanned at a pitch of 20 μm in the weft direction with the displacement gauge under the following measurement conditions to determine the three dimensional shape: a measurement range of 8,000 μm (warp direction); measurement points of 401 points; and an initial distance of 5.5 mm. The measured values thus obtained are taken in three dimensional shape analysis software (trade name of LMS-3D Ver. 3.7, manufactured by Sigma Koki Co., Ltd.), and the surface roughness ($R_a$) is calculated from the following formula (1) defined by JIS B-0601:

$$R_a = \frac{1}{L}\int^{L} |Z|\, dx \tag{1}$$

wherein L is a profile length (μm), and Z is a distance (μm) from the centerline.

The above procedure is repeated ten times (n=10) at a pitch of 800 μm in the warp direction. The surface roughness values (n=10) thus obtained are averaged, and the averaged value is defined as a surface roughness ($R_a$) of the woven fabric.

(5) Elastic Recovery (%) at 10% Elongation

A yarn is attached to a tensile testing machine with a chuck-to-chuck distance of 10 cm, elongated at a tensile rate of 20 cm/min until the elongation reaches 10%, allowed to stand for 1 minute, and then shrunk at the same rate to give a stress-strain curve. The elastic recovery (%) is obtained from the following formula:

$$\text{elastic recovery at 10\% elongation (\%)}=[(10-A)/10]\times 100$$

wherein A is a residual elongation that is an elongation when the stress becomes zero during shrinking.

(6) Stretch Elongation (%) and Stretch Modulus (%)

Measurements are made in accordance with the stretchability testing method (C method) by JIS L-1090. The sample is pretreated with dry heat at 90° C. for 15 minutes under a load of 0.03 cN/dtex, and allowed to stand for a whole day and night.

(7) Feel

Ten panelists are asked to touch each woven fabric, and they judged the feel from the touch.

Each of the ten panelists evaluated the fabric, and gave 0 point when the fabric has a hard feel, and 1 point when the fabric has a flexible feel. The feel (flexibility) of the fabric is judged from the total points given by the panelists according to the following criteria: ◎ for 9 to 10 points; ○ for 7 to 8 points; Δ for 4 to 6 points; and X for 0 to 3 points (8) Wrinkle Resistance A sample, 20 cm×20 cm, is taken from a woven fabric, bent in a bellows-like shape at 2-cm intervals, and sandwiched between two aluminum plates. A 200-g weight is placed on the top aluminum plate, and the sandwiched sample is allowed to stand for 10 minutes. The weight and aluminum plates are then removed. The sample in a wrinkled state directly after the removal thereof is evaluated according to 5 grades, from the first to the fifth grade using the wrinkle judging plate according to AATCC.

(9) Comfortable Feeling for the Wearer

Three pairs of slacks are prepared from each of the fabrics. Three panelists are asked to wear respective pairs of slacks for a week. Each panelist evaluates the comfortable feeling of the pair of slacks the panelist has worn according to the following three ranks: rank A (excellent comfortable feeling); rank B (ordinary comfortable feeling); and rank C (poor comfortable feeling).

Each of the fabrics is judged in accordance with the following criteria: ⊚ the three panelists all judge the fabric to be rank A; o two out of the three panelists judge the fabric to be rank A; x at least two panelists out of the three panelists judge the fabric to be rank C; and Δ other than the above cases.

(10) Snagging Resistance

The snagging is measured in accordance with D-3 method of JIS L-1058 (method in which two metal saws are attached to two faces, respectively within a rotary box).

EXAMPLE 1

A PTT having a reduced viscosity ($\eta_{sp}/c$) of 0.8 was spun at a spinning temperature of 265° C. and a spinning rate of 1,200 m/min to give an undrawn yarn. The undrawn yarn was then drawn and twisted at a hot roll temperature of 60° C., a hot plate temperature of 140° C., a draw ratio of 3 and a drawing rate of 800 m/min to give a drawn yarn of 56 dtex/24 f. The drawn yarn showed a strength of 3.4 cN/dtex, an elongation of 46%, an elastic modulus of 23.4 cN/dtex and an elastic recovery at 10% elongation of 98%.

A PTT multifilamentary yarn of 84 dtex/24 f obtained in the same manner as explained above was false twisted at a false-twist number of 3,400 T/m (twist factor of false twisting of 31,162) with a pin type false-twisting machine to give a nonset type of a false-twisted yarn. Additional twisting is imparted to the false-twisted yarn at a false-twist number of 700 T/m (twist factor of false twisting of 6,416) in the direction reverse to that of the former false twisting with a double twister (trade name of DT-308, manufactured by Murata Manufacturing Co., Ltd.), and steam set at 80° C. for 40 minutes to give a texturized yarn.

The former non-twisted sized yarn of the PTT multifilamentary yarn of 56 dtex/24 f used as a warp yarn and the latter textured yarn used as a weft yarn were picked by alternate feeding of one yarn in an S/Z manner to give a gray fabric of 2/2 weft ribbed weave having a density of 150 ends/2.54 cm and 89 picks/2.54 cm.

The gray fabric thus obtained was scoured with open width at 95° C. with a U type soft relaxing machine, relaxed with open width, dry heat relaxed with open width at 160° C. with a shrink surfer, intermediate set at 170° C. with a tenter, dyed with a dispersion dye at 120° C. using a jet dyeing machine, and final set at 170° C. to give a fabric having a density of 210 ends/2.54 cm and 96 picks/2.54 cm.

As shown in Table 1, the fabric thus obtained showed extremely excellent surface flatness (namely, small surface roughness) and high stretchability in the weft direction.

EXAMPLE 2

A fabric having a density of 208 ends/2.54 cm and 94 picks/2.54 cm was obtained in the same manner as in Example 1 except that a yarn of 56 dtex/36 f composed of a concentrical core-sheath type PET fiber that was formed from a core portion containing 8.0% by weight of titanium oxide and a sheath portion containing 0.5% by weight of titanium oxide with a core-to-sheath mass ratio of 1/1 was used as a warp yarn, that the gray fabric was made to have a density of 148 ends/2.54 cm and 88 picks/2.54 cm, and that the dyeing temperature was set at 120° C.

As shown in Table 1, the fabric thus obtained showed extremely excellent surface flatness and high stretchability in the weft direction.

EXAMPLE 3

A PTT multifilamentary yarn of 84 dtex/36 f obtained in the same manner as in Example 1 was false twisted at a false-twist number of 3,400 T/m (twist factor of false twisting of 31,162) with a pin type false twisting machine to give a nonset type false-twisted yarn. A fabric having a density of 208 ends/2.54 cm and 94 picks/2.54 cm was obtained in the same manner as in Example 2 except that the false-twisted yarn was used as a weft yarn and that the gray fabric was made have a density of 149 ends/2.54 cm and 88 picks/2.54 cm.

As shown in Table 1, the fabric thus obtained showed excellent surface flatness and suitable stretchability in the weft direction.

EXAMPLE 4

A fabric having a density of 196 ends/2.54 cm and 120 picks/2.54 cm was obtained in the same manner as in Example 2 except that the false-twisted yarn of the PTT multifilamentary yarn of 84 dtex/24 f obtained in Example 1 was used as a weft yarn, that the weave texture was made a 2/2 twill weave, and that the gray fabric was made to have a density of 139 ends/2.54 cm and 110 picks/2.54 cm.

As shown in Table 1, the fabric thus obtained showed excellent surface flatness and excellent stretchability in the weft direction.

EXAMPLE 5

A fabric having a density of 192 ends/2.54 cm and 118 picks/2.54 cm was obtained in the same manner as in Example 3 except that the weave texture was made a 2/2 twill weave, and that the gray fabric was made have a density of 138 ends/2.54 cm and 111 picks/2.54 cm.

As shown in Table 1, the fabric thus obtained showed excellent surface flatness and excellent stretchability in the weft direction.

EXAMPLE 6

A fabric having a density of 190 ends/2.54 cm and 144 picks/2.54 cm was obtained in the same manner as in Example 5 except that a false-twisted yarn of a PTT multifilamentary yarn of 56 dtex/24 f to which additional twisting was imparted at a twist number of 850 T/m (twist factor of additional twist of 6,360) in the direction reverse to the false twisting direction was used as a weft yarn, and that the gray fabric was made to have a density of 138 ends/2.54 cm and 136 picks/2.54 cm.

As shown in Table 1, the fabric thus obtained showed excellent surface flatness and excellent stretchability in the weft direction.

EXAMPLE 7

A fabric having a density of 158 ends/2.54 cm and 115 picks/2.54 cm was obtained in the same manner as in Example 4 except that a concentrical core-sheath type PET multifilamentary yarn of 84 dtex/36 f that was formed from a core portion containing 8.0% by weight of titanium oxide and a sheath portion containing 0.5% by weight of titanium oxide with a core-to-sheath mass ratio of 1/1 was used as a warp yarn, and that the gray fabric was made to have a density of 116 ends/2.54 cm and 110 picks/2.54 cm.

As shown in Table 1, the fabric thus obtained showed excellent surface flatness and excellent stretchability in the weft direction.

EXAMPLE 8

A fabric having a density of 202 ends/2.54 cm and 123 picks/2.54 cm was obtained in the same manner as in Example 5 except that a PET multifilamentary yarn of 56 dtex/30 f having a W-shaped cross section was used as a warp yarn, that the gray fabric was made to have a density of 142 ends/2.54 cm and 111 picks/2.54 cm, and that the fabric was heat calender finished at 130° C.

As shown in Table 1, the fabric thus obtained showed extremely excellent surface flatness and suitable stretchability in the weft direction. The fabric showed a water resistance of 420 mm $H_2O$, and provides a soft feeling.

EXAMPLE 9

A fabric having a density of 199 ends/2.54 cm and 123 picks/2.54 cm was obtained in the same manner as in Example 8 except that a PTT multifilamentary yarn of 84 dtex/72 f was used as a weft yarn, and that the gray fabric was made to have a density of 140 ends/2.54 cm and 111 picks/2.54 cm.

As shown in Table 1, the fabric thus obtained showed extremely excellent surface flatness and suitable stretchability in the weft direction. The fabric showed a water resistance of 410 mm $H_2O$, and provides a soft feeling.

EXAMPLE 10

A PTT multifilamentary yarn of 84 dtex/24 f was twisted at a twist number of 900 T/m (twist factor of 8,249) with a double twister (trade name of DT-308, manufactured by Murata Manufacturing Co., Ltd.), steam set at 80° C. for 40 minutes, and false twisted at a false-twist number of 3,400 T/m (twist factor of false twist of 31,162) in the direction reverse to the pre-twisting direction with a pin type false twisting machine to give a pre-twisted false-twisted yarn. The resultant yarn was steam set at 80° C. for 40 minutes to give a textured yarn (A).

Furthermore, the PET multifilamentary yarn of 84 dtex/36 f used as a warp yarn in Example 7 was false twisted at a false-twist number of 3,400 T/m (twist factor of false twisting of 31,162) with a pin type false twisting machine to give a nonset type false-twisted yarn. The yarn was then subjected to additional twisting at a twist number of 700 T/m (twist factor of false twisting of 6,416) in the direction reverse to the false twisting direction with a double twister (trade name of DT-308, manufactured by Murata Manufacturing Co., Ltd.), and steam set at 80° C. for 40 minutes to give a textured yarn of S twisted yarn (B).

The textured yarn (A) obtained above was used as a warp yarn (pre-twisted false-twisted yarn in the direction reverse to S twisting), and the textured yarn of S twisted yarn (B) was used as a weft yarn; a woven fabric of a plain weave was then obtained. The woven fabric was relaxation scoured at 95° C. with a U-type softening machine, jet relaxed at 105° C., free relaxed with dry heat at 150° C., intermediate set at 170° C., jet dyed at 135° C., free relaxed with dry heat at 150° C. and final set at 170° C. to give a gray fabric having a density of 127 ends/2.54 cm and 90 picks/2.54 cm. The fabric was then finished in the same manner as in Example 1 to give a fabric having a density of 153 ends/2.54 cm and 113 picks/2.54 cm.

As shown in Table 1, the fabric thus obtained showed extreme surface flatness and suitable stretchability in the warp direction.

EXAMPLE 11

A fabric having a density of 150 ends/2.54 cm and 136 picks/2.54 cm was obtained in the same manner as in Example 10 except that additional twisting was imparted to the weft yarn at a twist number of 330 T/m (twist factor of additional twist of 3,024), that the weave texture was made a 2/2 twill weave, and that the gray fabric was made to have a density of 113 ends/2.54 cm and 92 picks/2.54 cm.

As shown in Table 1, the fabric thus obtained showed extreme surface flatness and suitable stretchability in the warp direction.

EXAMPLE 12

A fabric having a density of 145 ends/2.54 cm and 135 picks/2.54 cm was obtained in the same manner as in Example 11 except that a PTT multifilamentary yarn is used as a weft yarn, that the gray fabric was made to have a density of 111 ends/2.54 cm and 101 picks/2.54 cm, and that the jet dyeing temperature was set at 120° C.

As shown in Table 1, the fabric thus obtained showed extreme surface flatness and suitable stretchability in the warp and weft directions.

EXAMPLE 13

A fabric having a density of 171 ends/2.54 cm and 119 picks/2.54 cm was obtained in the same manner as in Example 12 except that the same yarn as the warp yarn used in Example 10 was used as a weft yarn, and that the gray fabric was made to have a density of 118 ends/2.54 cm and 92 picks/2.54 cm.

As shown in Table 1, the fabric thus obtained showed extreme surface flatness and suitable stretchability in the warp and weft directions.

EXAMPLE 14

A fabric having a density of 214 ends/2.54 cm and 101 picks/2.54 cm was obtained in the same manner as in Example 8 except that the weft yarn was twisted at an additional twist number of 500 T/m (twist factor of additional twist of 4,583), that the weave texture was made a 2/2 weft ribbed weave, and that the gray fabric was made to have a density of 166 ends/2.54 cm and 93 picks/2.54 cm.

As shown in Table 1, the fabric thus obtained showed extreme surface flatness and high stretchability in the weft direction. The fabric showed a water resistance of 300 mm $H_2O$, and has a soft feel.

EXAMPLE 15

A fabric having a density of 206 ends/2.54 cm and 100 picks/2.54 cm was obtained in the same manner as in Example 14 except that the weft was twisted at an additional twist number of 700 T/m (twist factor of additional twist of 6,416), and that the gray fabric was made to have a density of 162 ends/2.54 cm and 92 picks/2.54 cm.

As shown in Table 1, the fabric thus obtained showed extreme surface flatness and high stretchability in the weft direction. The fabric showed a water resistance of 300 mm $H_2O$, and has a soft feel.

EXAMPLE 16

A fabric having a density of 212 ends/2.54 cm and 101 picks/2.54 cm was obtained in the same manner as in Example 14 except that the gray fabric was made to have a density of 170 ends/2.54 cm and 93 picks/2.54 cm.

As shown in Table 1, the fabric thus obtained showed extreme surface flatness and suitable stretchability in the weft direction. The fabric showed a water resistance of 320 mm $H_2O$, and has a soft feel.

EXAMPLE 17

A fabric having a density of 210 ends/2.54 cm and 100 picks/2.54 cm was obtained in the same manner as in Example 15 except that the gray fabric was made to have a density of 170 ends/2.54 cm and 92 picks/2.54 cm.

As shown in Table 1, the fabric thus obtained showed extreme surface flatness and suitable stretchability in the weft direction. The fabric showed a water resistance of 300 mm $H_2O$, and provides a soft feeling.

EXAMPLE 18

A fabric having a density of 181 ends/2.54 cm and 112 picks/2.54 cm was obtained in the same manner as in Example 1 except that the weave texture was made a 2/2 twill weave, and that the gray fabric was made to have a density of 119 ends/2.54 cm and 100 picks/2.54 cm.

As shown in Table 1, the fabric thus obtained showed extreme surface flatness and extremely high stretchability in the weft direction.

EXAMPLE 19

A fabric having a density of 131 ends/2.54 cm and 96 picks/2.54 cm was obtained in the same manner as in Example 18 except that the weave texture was made a plain weave, and that the gray fabric was made to have a density of 97 ends/2.54 cm and 87 picks/2.54 cm.

As shown in Table 1, the fabric thus obtained showed extreme surface flatness and high stretchability in the weft direction.

EXAMPLE 20

A PTT multifilamentary yarn of 56 dtex/24 f was false twisted at a false-twist number of 3,800 T/m (twist factor of false twisting of 28,437) with a pin type false twisting machine to give a nonset type false-twisted yarn. The yarn was then subjected to additional twisting at a twist number of 850 T/m (twist factor of additional twist of 6,361) in the direction reverse to the false twisting direction with a double twister (trade name of DT-308, manufactured by Murata Manufacturing Co., Ltd.), and steam set at 80° C. for 40 minutes to give a textured yarn (C).

Furthermore, a regular PET multifilamentary yarn of 84 dtex/36 f was false twisted at a false-twist number of 3,400 T/m (twist factor of false twist of 31,162) with a pin type false twisting machine to give a nonset type false-twisted yarn. The yarn was subjected to additional twisting at a twist number of 700 T/m (twist factor of additional twist of 6,416) in the direction reverse to the false twisting direction with a double twister (trade name of DT-308, manufactured by Murata Manufacturing Co., Ltd.), and steam set at 80° C. for 40 minutes to give a textured yarn (D).

The textured yarn (C) obtained above was used as a warp yarn, and the textured yarn (D) was used as a weft yarn; a gray fabric having a 2/2 weft ribbed weave and a density of 146 ends/2.54 cm and 78 picks/2.54 cm was obtained. The gray fabric was finished in the same manner as in Example 10 to give a fabric having a density of 168 ends/2.54 cm and 98 picks/2.54 cm.

As shown in Table 1, the fabric thus obtained showed extreme surface flatness, and high stretchability in the warp direction.

EXAMPLE 21

A fabric having a density of 152 ends/2.54 cm and 144 picks/2.54 cm was obtained in the same manner as in Example 20 except that the weave texture was made a 2/2 twill weave and that the gray fabric was made to have a density of 134 ends/2.54 cm and 110 picks/2.54 cm.

As shown in Table 1, the fabric thus obtained showed extreme surface flatness, and high stretchability in the warp direction.

EXAMPLE 22

A fabric having a density of 207 ends/2.54 cm and 95 picks/2.54 cm was obtained in the same manner as in Example 20 except that the same weft yarn as in Example 1 was used, that the gray fabric was made to have a density of 149 ends/2.54 cm and 77 picks/2.54 cm, and that the dyeing temperature was set at 120° C.

As shown in Table 1, the fabric thus obtained showed extreme surface flatness, and high stretchability in the warp and weft directions.

EXAMPLE 23

A fabric having a density of 189 ends/2.54 cm and 142 picks/2.54 cm was obtained in the same manner as in Example 22 except that the weave texture was made a 2/2 twill weave and that the gray fabric was made to have a density of 136 ends/2.54 cm and 111 picks/2.54 cm.

As shown in Table 1, the fabric thus obtained showed extreme surface flatness, and high stretchability in the warp and weft directions.

EXAMPLE 24

A fabric having a density of 207 ends/2.54 cm and 99 picks/2.54 cm was obtained in the same manner as in Example 1 except that a reverse twisted false-twisted yarn of a PTT multifilamentary yarn of 84 dtex/24 f with an additional twist number of 700 T/m (twist factor of additional twist of 6,416) was used as a weft yarn, and that the gray fabric was made to have a density of 152 ends/2.54 cm and 89 picks/2.54 cm.

As shown in Table 1, the fabric thus obtained showed extreme surface flatness, and high stretchability in the weft direction.

EXAMPLE 25

A fabric having a density of 133 ends/2.54 cm and 97 picks/2.54 cm was obtained in the same manner as in Example 24 except that the weave texture was made a plain weave, and that the gray fabric was made to have a density of 98 ends/2.54 cm and 88 picks/2.54 cm.

As shown in Table 1, the fabric thus obtained showed extreme surface flatness, and high stretchability in the weft direction.

EXAMPLE 26

A PTT multifilamentary yarn of 56 dtex/24 f was twisted at a twist number of 850 T/m (twist factor of 6,361) with a double twister (trade name of DT-308, manufactured by Murata Manufacturing Co., Ltd.), steam set at 80° C. for 40 minutes, and false twisted at a false twist number of 4,300 T/m (twist factor of false twist of 32,178) in the direction reverse to the pre-twisting direction with a pin type false twisting machine to give a false-twisted yarn of pre-twisted yarn. The yarn was then steam set at 80° C. for 40 minutes to give a textured yarn (reverse twisted false-twisted yarn with a single twist).

A fabric having a density of 192 ends/2.54 cm and 149 picks/2.54 cm was obtained in the same manner as in Example 10 except that the textured yarn obtained above was used as a warp yarn, that the same yarn as used in Example 24 was used as a weft yarn, that the weave texture was made a 2/2 twill weave, that the gray fabric was made to have a density of 135 ends/2.54 cm and 112 picks/2.54 cm, and that the dyeing temperature was set at 120° C.

As shown in Table 1, the fabric thus obtained showed extreme surface flatness, and high stretchability in the warp and weft directions.

EXAMPLE 27

A fabric having a density of 193 ends/2.54 cm and 98 picks/2.54 cm was obtained in the same manner as in Example 26 except that a false-twisted yarn of a PTT multifilamentary yarn of 84 dtex/24 f was used in a non-twisted state, that the weave texture was made a 2/2 weft ribbed weave, and that the gray fabric was made to have a density of 150 ends/2.54 cm and 75 picks/2.54 cm.

As shown in Table 1, the fabric thus obtained showed extreme surface flatness, and high stretchability in the warp and weft directions.

EXAMPLE 28

A fabric having a density of 182 ends/2.54 cm and 145 picks/2.54 cm was obtained in the same manner as in Example 27 except that a Z-twisted yarn was used as a weft yarn, that the weave texture was made a 2/2 twill weave, and that the gray fabric was made to have a density of 137 ends/2.54 cm and 110 picks/2.54 cm.

As shown in Table 1, the fabric thus obtained showed extreme surface flatness, and high stretchability in the warp and weft directions.

COMPARATIVE EXAMPLE 1

A fabric having a density of 116 ends/2.54 cm and 96 picks/2.54 cm was obtained in the same manner as in Example 1 except that the same weft yarn as used in Example 27 was used, that the weave texture was made a plain weave, and that the gray fabric was made to have a density of 97 ends/2.54 cm and 88 picks/2.54 cm.

As shown in Table 1, the fabric thus obtained showed poor stretchability in the weft direction and a significant crepe-like effect.

COMPARATIVE EXAMPLE 2

A fabric having a density of 132 ends/2.54 cm and 97 picks/2.54 cm was obtained in the same manner as in Comparative Example 1 except that, among the false-twisted yarns used in Example 27, the Z direction false-twisted yarn was only used as a weft yarn, and that the gray fabric was made to have a density of 98 ends/2.54 cm and 89 picks/2.54 cm.

As shown in Table 1, the fabric thus obtained showed a striped crepe-like effect and a significant crepe-like effect although it exhibited stretchability in the weft direction.

COMPARATIVE EXAMPLE 3

A fabric having a density of 120 ends/2.54 cm and 97 picks/2.54 cm was obtained in the same manner as in Comparative Example 1 except that a yarn prepared by imparting additional twisting to the same textured yarn as used in Example 27 at a twist number of 700 T/m (twist factor of additional twist of 6,416) in the direction identical to the false twisting direction and steam setting at 80° C. for 40 minutes was picked as a weft yarn, and that the gray fabric was made to have a density of 98 ends/2.54 cm and 88 picks/2.54 cm.

As shown in Table 1, the fabric thus obtained showed poor stretchability in the weft direction.

COMPARATIVE EXAMPLE 4

A fabric having a density of 129 ends/2.54 cm and 98 picks/2.54 cm was obtained in the same manner as in Comparative Example 1 except that a yarn prepared by imparting additional twisting to the same textured yarn as used in Example 27 at a twist number of 150 T/m (twist factor of additional twist of 1,375) in the direction reverse to the false twisting direction and steam setting at 80° C. for 40 minutes was picked as a weft yarn, and that the gray fabric was made to have a density of 97 ends/2.54 cm and 88 picks/2.54 cm.

As shown in Table 1, the fabric thus obtained showed a significant crepe-like effect although it showed stretchability in the weft direction.

COMPARATIVE EXAMPLE 5

A fabric having a density of 112 ends/2.54 cm and 96 picks/2.54 cm was obtained in the same manner as in Comparative Example 1 except that a yarn prepared by imparting additional twisting to the same textured yarn as used in Example 27 at a twist number of 1,500 T/m (twist factor of additional twist of 13,747) in the direction reverse to the false twisting direction and steam setting at 80° C. for 40 minutes was picked as a weft yarn, and that the gray fabric was made to have a density of 99 ends/2.54 cm and 87 picks/2.54 cm.

As shown in Table 1, the fabric thus obtained showed a significant crepe-like effect in addition to poor stretchability in the weft direction.

COMPARATIVE EXAMPLE 6

A fabric having a density of 105 ends/2.54 cm and 97 picks/2.54 cm was obtained in the same manner as in Comparative Example 1 except that a yarn prepared by imparting additional twisting to a nonset type false-twisted yarn of a regular PET multifilamentary yarn of 84 dtex/36 f at a twist number of 700 T/m (twist factor of additional twist of 6,416) in the direction identical to the false twisting direction and steam setting at 80° C. for 40 minutes was inserted as a weft yarn, that the gray fabric was made to have a density of 94 ends/2.54 cm and 89 picks/2.54 cm, and that the dyeing temperature was set at 135° C.

As shown in Table 1, the fabric thus obtained showed poor stretchability in the weft direction.

COMPARATIVE EXAMPLE 7

A regular PET multifilamentary yarn of 84 dtex/36 f was twisted at a twist number of 700 T/m (twist factor of 6,416) with a double twister (trade name of DT-308, manufactured by Murata Manufacturing Co., Ltd.), and steam set at 80° C.

for 40 minutes. The resultant yarn was then false twisted at a false-twist number of 3,400 T/m (false twist factor of 31,162) in the direction reverse to the pre-twisting direction with a pin type false twisting machine to give a textured yarn.

A fabric having a density of 154 ends/2.54 cm and 122 picks/2.54 cm was obtained in the same manner as in Comparative Example 1 except that the textured yarn obtained above was used as a weft yarn, that the weave texture was made a 2/2 twill weave, that the gray fabric was made to have a density of 134 ends/2.54 cm and 109 picks/2.54 cm, and that the dyeing temperature was set at 135° C.

As shown in Table 1, the fabric thus obtained showed poor stretchability in the weft direction.

EXAMPLE 29

A PTT having a reduced viscosity ($\eta_{sp}/c$) of 0.8 was spun at a spinning temperature of 265° C. at a spinning rate of 1,200 m/min to give an undrawn yarn. The undrawn yarn was then drawn and twisted at a draw ratio of 3 at a hot roll temperature of 60° C., a hot plate temperature of 140° C. and a drawing rate of 800 m/min to give a drawn yarn of 167 dtex/48 f. The drawn yarn showed a strength of 4.0 cN/dtex, an elongation of 46%, an elastic modulus of 24.2 cN/dtex and an elongation recovery at 10% elongation of 98%.

The PTT multifilamentary yarn of 167 dtex/48 f obtained by the above method was false twisted at a twist number of 2,400 T/m (false twist factor 31,014) with a pin type false twisting machine to give a nonset type false-twisted yarn. The false-twisted yarn was subjected to additional twisting at a twist number of 800 T/m (twist factor of additional twist of 10,338) in the direction reverse to the false twisting direction with a double twister (trade name of DT-308, manufactured by Murata Manufacturing Co., Ltd.), and steam set at 80° C. for 40 minutes to give a textured yarn (E).

A textured yarn (F) was similarly obtained by imparting additional twisting at a twist number of 400 T/m (twist factor of additional twist of 5,169) in the direction reverse to the false twisting direction.

The textured yarns (E) and (F) obtained above were used as a warp yarn and a weft yarn, respectively. The warp yarn was picked by alternate feeding of two yarns in a SS/ZZ manner, and the weft yarn was picked by alternate feeding of one yarn in a S/Z manner to give a gray fabric having a 2/2 weft ribbed weave and a density of 114 ends/2.54 cm and 56 picks/2.54 cm. The gray fabric was scoured with an open width at 95° C. and relaxed with an open width using a jet dyeing machine, dry heat relaxed with an open width at 160° C. using a shrink surfer, and intermediate set at 160° C. with a tenter.

The fabric was then subjected to alkali reduction (reduction ratio of 8% by weight) under conditions described below, sufficiently washed, dispersion dyed at 120° C. with a jet dyeing machine, reduction washed, and dried. A softening agent was applied to the dried fabric, and the fabric was set at 160° C. to give a woven fabric having a density of 141 ends/2.54 cm and 77 picks/2.54 cm.

Table 2 shows the results of evaluating the woven fabric thus obtained. In addition, the woven fabric showed an elongation recovery at 4.9 N/cm stress of 90% prior to alkali reduction and 89% subsequently thereto. The resultant woven fabric compared with one that was not subjected to alkali reduction (shown by a figure in parentheses in Table 2) showed an unchanged outward appearance, had a very flexible feel, and exhibited high stretchability in the warp and weft directions and improved wrinkle resistance (degree of wrinkling). Moreover, the fabric substantially showed no substantial lowering of the tear strength.

Conditions of Reduction

Method of reduction: Pad steaming

Sodium hydroxide: 250 g/l

Penetrant: Neorate NA30 (10 g/l)

Squeezing ratio: 40%

Reduction: 8% by weight

EXAMPLE 30

A woven fabric having a density of 142 ends/2.54 cm and 78 picks/2.54 cm was obtained in the same manner as in Example 29 except that reduction was conducted by the method described below, and that an anion activating agent was used for removing the promoter composed of a quaternary ammonium salt during washing after reduction.

Table 2 shows the results of evaluating the woven fabric thus obtained. In addition, the woven fabric showed an elongation recovery at 4.9 N/cm stress of 90% prior to alkali reduction and 88% subsequently thereto. The woven fabric, similarly to the one in Example 29, showed unchanged surface designability, had a flexible feel, and exhibited a high stretch ratio, an increased wrinkle resistance and substantially no lowering of the strength.

Conditions of Reduction

Method of reduction: Jet reduction under normal pressure

Sodium hydroxide: 30 g/l

Reduction promoter: Neorate NCB (trade name, manufactured by Nicca Chemical Co., Ltd.) (1.5 g/l)

Reduction: 8% by weight

Anion activating agent during washing: Vicsen AG-25 (trade name, manufactured by Nicca Chemical Co., Ltd.) (3 g/l)

EXAMPLE 31

The reverse twisted yarn with additional twist having an additional twist number of 600 T/m (twist factor of additional twist of 7,754) that was used as a warp yarn in Example 29 was used as a warp yarn.

Moreover, a PTT multifilamentary yarn of 56 dtex/24 fil was false twisted at a false-twist number of 3,800 T/m (twist factor of false twist of 28,437) with a pin type false twisting machine to give a nonset type false-twisted yarn. The yarn was then subjected to additional twisting at a twist number of 1,200 T/m (twist factor of additional twist of 8,979) in the direction reverse to the false twisting direction with a double twister (trade name of DT-308, manufactured by Murata Manufacturing Co., Ltd.), and steam set at 80° C. for 40 minutes. The resultant yarn was used as a weft yarn.

The weft yarn was picked by alternate feeding in an S/Z manner to give a gray fabric having a density of 142 ends/2.54 cm and 71 picks/2.54 cm and a 2/1 twill weave. The gray fabric was treated in the same manner as in Example 29 to give a woven fabric showing a reduction of 8% by weight and having a density of 176 ends/2.54 cm and 74 picks/2.54 cm.

Table 2 shows the results of evaluating the woven fabric thus obtained. The woven fabric, similarly to Example 29, had a very good feel while maintaining the outward appearance, in comparison with the same woven fabric without reduction. The fabric also showed high stretchability in comparison therewith. Moreover, the fabric also showed improved wrinkle resistance and substantially no lowering of strength.

EXAMPLE 32

The same warp yarn as used in Example 31 was used as a warp yarn.

Moreover, a PTT multifilamentary yarn of 167 dtex/48 f was false twisted at a false-twist number of 2,500 T/m (twist factor of false twist of 31,014) with a nonset type false twisting machine to give a nonset type false-twisted yarn. The yarn was then subjected to additional twisting at a twist number of 350 T/m (twist factor of additional twist of 4,523) in the direction reverse to the false twisting direction with a double twister (trade name of DT-308, manufactured by Murata Manufacturing Co., Ltd.), and steam set at 80° C. for 40 minutes. The resultant yarn was used as a weft yarn.

The weft was picked by alternate feeding in an S/Z manner to give a gray fabric having a density of 104 ends/2.54 cm and 98 picks/2.54 cm and a 2/2 twill weave. The gray fabric was treated in the same manner as in Example 29 to give a woven fabric showing a reduction of 11% by weight and having a density of 131 ends/2.54 cm and 100 picks/2.54 cm.

Table 2 shows the results of evaluating the woven fabric thus obtained. The woven fabric had a significantly flexible feel while maintaining the outward appearance, in comparison with the same woven fabric without reduction, and showed an improved stretch ratio. The fabric further showed an improved wrinkle resistance and substantially no lowering of strength.

EXAMPLE 33

Two nonset type false-twisted yarns that were each prepared by false twisting a PTT multifilamentary yarn of 84 dtex/12 f at a false-twist number of 3,400 T/m (twist factor of false twist of 31,162) with a pin type false twisting machine were doubled, and subjected to additional twisting at a twist number of 500 T/m (additional-twist factor of 6,481) in the direction reverse to the false twisting direction with a double twister (trade name of DT-308, manufactured by Murata Manufacturing Co., Ltd.) to give a textured yarn.

The textured yarns thus obtained were used as warp yarns and weft yarns. The warp yarns were arranged in an SS/ZZ manner, and the weft yarns were arranged in an s/z manner to give a gray fabric having a density of 114 ends/2.54 cm and 107 picks/2.54 cm and a 2/2 twill weave. The gray fabric was treated in the same manner as in Example 30 to give a woven fabric showing a reduction of 7% by weight and having a density of 145 ends/2.54 cm and 108 picks/2.54 cm.

Table 2 shows the results of evaluating the woven fabric thus obtained. The woven fabric had a significantly flexible feel while maintaining the outward appearance, in comparison with the same woven fabric without reduction, and showed an improved stretch ratio. The fabric further showed an improved wrinkle resistance and substantially no lowering of strength.

EXAMPLE 34

A PTT multifilamentary raw yarn of 56 dtex/24 f was used as a warp yarn.

A nonset type false-twisted yarn obtained by false twisting a PTT multifilamentary yarn of 84 dtex/36 f at a false-twist number of 3,400 T/m (a false-twist factor of 31,162) was subjected to additional twisting at a twist number of 400 T/m (twist factor of additional twist of 3,666) in the direction reverse to the false twisting direction, and the resultant textured yarn was used as a weft yarn.

A warp yarn was picked in an SS/ZZ manner, and a weft yarn picked in an S/Z manner to give a gray fabric for a plain weave fabric having a density of 118 ends/2.54 cm and 96 picks/2.54 cm. The gray fabric was set with reduction in width at 160° C., scoured with an open soaper, subjected to alkali reduction under conditions described below, sufficiently washed, dispersion dyed at 120° C. with a jet dyeing machine, reduction washed, and dried. A softening agent was applied to the dried fabric, and the fabric was set at 160° C. to give a woven fabric with a reduction of 7% by weight having a density of 139 ends/2.54 cm and 101 picks/2.54 cm.

Table 2 shows the results of evaluating the woven fabric thus obtained. The woven fabric had a very flexible feel, and showed a high stretch ratio, a wrinkle resistance and substantially no lowering of strength when subjected to reduction.

Conditions of Reduction

Method of reduction: Reduction by boiling-in loop

Sodium hydroxide: 50 g/l

Reduction promoter; Neorate NCB (trade name, manufactured by Nicca Chemical Co., Ltd.) (5 g/l)

Reduction: 7% by weight

Anion activating agent during washing: Vicsen AG-25 (trade name, manufactured by Nicca Chemical Co., Ltd.) (3 g/l)

EXAMPLE 35

A cotton yarn having a cotton count of 60 was used as a warp yarn.

Furthermore, a PTT multifilamentary yarn of 84 dtex/24 f was false twisted at a twist number of 3,400 T/m (twist factor of false twist of 31,162) with a pin type false twisting machine to give a nonset type false-twisted yarn. The yarn was subjected to additional twisting at a twist number of 700 T/m (twist factor of additional twist of 6,416) in the direction reverse to the false twisting with a double twister (trade name of DT-308, manufactured by Murata Manufacturing Co., Ltd.), and steam set at 80° C. for 40 minutes. The resultant yarn was used as a weft yarn.

The weft yarn was picked by alternate feeding in an S/Z manner to give a gray fabric for a plain weave fabric having a density of 100 ends/2.54 cm and 96 picks/2.54 cm. The gray fabric was treated in the same manner as in Example 30 to give a woven fabric showing a reduction of 12% by weight and having a density of 130 ends/2.54 cm and 95 picks/2.54 cm.

Table 2 shows the results of evaluating the woven fabric thus obtained. The woven fabric had a significantly flexible and supple feel in comparison with a fabric obtained in the same manner without reduction, and showed an improved stretch ratio. Moreover, the woven fabric showed an improved wrinkle resistance and substantially no lowering of strength.

EXAMPLE 36

A gray fabric for a plain weave fabric having a density of 150 ends/2.54 cm and 140 picks/2.54 cm was obtained by using the same warp yarn and weft yarn as used in Example 35. The gray fabric was treated in the same manner as in Example 2 to give a woven fabric having a density of 168 ends/2.54 cm and 141 picks/2.54 cm.

Table 2 shows the results of evaluating the woven fabric thus obtained. The woven fabric had a very flexible feel although it was a woven fabric having a high density, and showed a stretch ratio as high as 15%. Moreover, the fabric was wrinkle-resistant and showed substantially no lowering of strength when subjected to reduction.

EXAMPLE 37

A gray fabric with a 3/1 twill weave having a density of 92 ends/2.54 cm and 55 picks/2.54 cm was obtained by using a cotton yarn having a cotton count of 16 as a warp yarn and the same weft yarn as used in Example 1. The gray fabric was treated in the same manner as in example 30 to give a woven fabric showing a reduction of 14% by weight, and having a density of 115 ends/2.54 cm and 57 picks/2.54 cm.

Table 2 shows the results of evaluating the woven fabric thus obtained. The woven fabric had a very flexible feel in comparison with a woven fabric prepared in the same manner without reduction, and showed a stretch ratio as high as 20%. Moreover, the fabric showed improved wrinkle resistance and substantially no lowering of strength when subjected to reduction.

EXAMPLE 38

A gray fabric with a 2/2 twill weave having a density of 150 ends/2.54 cm and 92 picks/2.54 cm was obtained by using a warp yarn that was prepared by twisting a rayon yarn of 133 dtex at a twist number of 1,600 T/m, and a weft yarn that was the same weft yarn as used in Example 29. The gray fabric was scoured with a jet dyeing machine at 95° C., set at 150° C., and subjected to alkali reduction (reduction ratio of 8% by weight) with a jet dyeing machine under the conditions described below.

The fabric was subsequently subjected to one bath-two step dyeing with dispersion dye/direct dye at 120° C. using a jet dyeing machine. The dyed fabric was washed, fixed, and dried. A softening agent was applied to the dried fabric, and it was set at 150° C. to give a woven fabric having a density of 169 ends/2.54 cm and 95 picks/2.54 cm.

Table 2 shows the results of evaluating the woven fabric thus obtained. The woven fabric had a rayon touch and a very flexible feel although it had a high density, and showed a high stretch ratio, a wrinkle resistance and substantially no lowering of strength when subjected to reduction.

Conditions of Reduction

Method of reduction: Jet reduction under normal pressure

Sodium hydroxide: 3 g/l

Reduction promoter: Neorate NCB (trade name, manufactured by Nicca Chemical Co., Ltd.): 5 g/l Reduction: 13% by weight Anion activating agent during washing: Vicsen AG-25 (trade name, manufactured by Nicca Chemical Co., Ltd.) (3 g/l)

COMPARATIVE EXAMPLE 8

A woven fabric having a density of 130 ends/2.54 cm and 69 picks/2.54 cm was obtained in the same manner as in Example 29 (reduction of 8% by weight) except that a PET multifilamentary yarn was used in place of the PTT multifilamentary yarn, and that the amount of the promoter was decreased during the reduction.

Table 2 shows the results of evaluating the woven fabric thus obtained. Because the woven fabric showed substantially no effects of being made flexible in comparison with the same fabric that was not subjected to reduction, the fabric had a very stiff feel, showed no improvement in the stretch ratio and low stretchability. Moreover, the fabric showed no improvement in the wrinkle resistance.

COMPARATIVE EXAMPLE 9

A woven fabric having a density of 135 ends/2.54 cm and 71 picks/2.54 cm was obtained in the same manner as in Comparative Example 8 except that the conditions of alkali reduction were altered to make the reduction as high as 35% by weight for the purpose of making the feel flexible.

Table 2 shows the results of evaluating the woven fabric thus obtained. Although the woven fabric was made to have a fairly flexible feel by the high reduction, the fabric showed poor flexibility and poor stretchability in comparison with the woven fabrics in Examples 29 and 30. Moreover, the high reduction of the fabric caused significant lowering of the strength and shifts of weaves.

TABLE 1

| | Surface | Stretch ratio (%) | | | Comfortable | Elongation Recovery (%) | |
|---|---|---|---|---|---|---|---|
| | roughness $R_a$ (μm) | Warp direction | Weft direction | Snagging (grade) | feeling to wearer | Warp direction | Weft direction |
| Ex. 1 | 21.2 | 4 | 32 | 4 | ◎ | — | 78 |
| Ex. 2 | 18.3 | 5 | 29 | 4 | ◎ | — | 86 |
| Ex. 3 | 19.2 | 5 | 29 | 4 | ◎ | — | 86 |
| Ex. 4 | 20.1 | 4 | 36 | 3–4 | ◎ | — | 83 |
| Ex. 5 | 19.7 | 5 | 33 | 3–4 | ◎ | — | 84 |
| Ex. 6 | 15.6 | 4 | 29 | 3–4 | ◎ | — | 81 |
| Ex. 7 | 22.8 | 4 | 33 | 3–4 | ◎ | — | 84 |
| Ex. 8 | 15.2 | 4 | 22 | 3–4 | ◎ | — | 82 |
| Ex. 9 | 14.7 | 4 | 21 | 3–4 | ◎ | — | 84 |
| Ex. 10 | 28.3 | 17 | 12 | 4 | ○ | 93 | 86 |
| Ex. 11 | 26.1 | 18 | 14 | 3–4 | ○ | 88 | 85 |
| Ex. 12 | 25.3 | 17 | 21 | 4 | ◎ | 86 | 86 |
| Ex. 13 | 26.8 | 16 | 24 | 4 | ◎ | 89 | 78 |
| Ex. 14 | 14.6 | 4 | 25 | 3–4 | ◎ | — | 76 |
| Ex. 15 | 14.2 | 4 | 23 | 3–4 | ◎ | — | 76 |
| Ex. 16 | 13.8 | 3 | 19 | 3–4 | ○ | — | 74 |
| Ex. 17 | 13.4 | 3 | 18 | 3–4 | ○ | — | 75 |

TABLE 1-continued

| | Surface roughness $R_a$ ($\mu$m) | Stretch ratio (%) Warp direction | Stretch ratio (%) Weft direction | Snagging (grade) | Comfortable feeling to wearer | Elongation Recovery (%) Warp direction | Elongation Recovery (%) Weft direction |
|---|---|---|---|---|---|---|---|
| Ex. 18 | 20.5 | 6 | 40 | 4 | ⊙ | | |
| Ex. 19 | 27.3 | 4 | 18 | 4 | ○ | — | 81 |
| Ex. 20 | 22.3 | 22 | 12 | 3–4 | ⊙ | | |
| Ex. 21 | 21.7 | 28 | 13 | 3–4 | ⊙ | | |
| Ex. 22 | 23.1 | 20 | 38 | 4 | ⊙ | | |
| Ex. 23 | 23.0 | 26 | 41 | 4 | ⊙ | | |
| Ex. 24 | 18.7 | 5 | 38 | 4 | ⊙ | | |
| Ex. 25 | 23.2 | 4 | 24 | 4 | ⊙ | — | 82 |
| Ex. 26 | 24.5 | 31 | 40 | 4 | ⊙ | | |
| Ex. 27 | 27.4 | 29 | 24 | 3–4 | ⊙ | | |
| Ex. 28 | 29.2 | 28 | 26 | 3–4 | ⊙ | | |
| C. E. 1 | 33.6 | 4 | 7 | 4 | X | | |
| C. E. 2 | 38.2 | 3 | 32 | 4 | ⊙ | | |
| C. E. 3 | 23.8 | 4 | 10 | 4 | Δ | | |
| C. E. 4 | 32.1 | 4 | 26 | 4 | ⊙ | | |
| C. E. 5 | 36.7 | 3 | 6 | 4 | X | | |
| C. E. 6 | 23.8 | 4 | 7 | 3 | X | | |
| C. E. 7 | 22.0 | 6 | 14 | 2–3 | X | | |

TABLE 2

| | Structure of woven fabric: Warp yarn | Structure of woven fabric: Weft yarn | Reduction (%) | Stretch ratio*: Warp direction | Stretch ratio*: Weft direction | Feel* | Wrinkle resistance* | Snagging | Comfortable feeling to wearer | Surface roughness* | Number of micro-craters* |
|---|---|---|---|---|---|---|---|---|---|---|---|
| Ex. 29 | 167 dtex/48f PTT RTFY | 167 dtex/48f PTT RTFY | 8 | 15 (10) | 18 (15) | ○ (Δ) | $4^{th}$ ($3^{rd}$) | $4^{th}$ | ○ | 38 (40) | 79 (0) |
| Ex. 30 | 167 dtex/48f PTT RTFY | 167 dtex/48f PTT RTFY | 8 | 16 (10) | 22 (15) | ○ (Δ) | $4^{th}$ ($3^{rd}$) | $4^{th}$ | ⊙ | 37 (40) | 80 (0) |
| Ex. 31 | 167 dtex/48f PTT RTFY | 56 dtex/24f PTT RTFY | 8 | 17 (11) | 15 (11) | ○ (Δ) | $4^{th}$ ($2^{nd}$-$3^{rd}$) | $4^{th}$ | ○ | 24 (30) | 128 (0) |
| Ex. 32 | 167 dtex/48f PTT RTFY | 167 dtex/48f PTT RTFY | 11 | 17 (11) | 21 (14) | ○ (Δ) | $4^{th}$ ($3^{rd}$) | $4^{th}$ | ⊙ | 83 (94) | 110 (0) |
| Ex. 33 | 84 dtex/ 12f PTT (two yarns) RTFY | 84 dtex/ 12f PTT (two yarns) RTFY | 8 | 19 (15) | 24 (15) | ○ (Δ) | $4^{th}$-$5^{th}$ ($3^{rd}$-$4^{th}$) | $3^{rd}$-$4^{th}$ | ⊙ | 29 (37) | 54 (2) |
| Ex. 34 | 56 dtex/24f PTT raw yarn | 84 dtex/36f PTT RTFY | 7 | — | 16 (11) | ⊙ (Δ) | $4^{th}$ ($3^{rd}$) | $4^{th}$ | ○ | 13 (15) | 136 (3) |
| Ex. 35 | Cotton 60 count | 84 dtex/24f PTT RTFY | 12 | — | 22 (16) | ⊙ (Δ) | $4^{th}$ ($3^{rd}$) | $3^{rd}$-$4^{th}$ | ⊙ | 26 (30) | 162 (1) |
| Ex. 36 | Cotton 60 count | 84 dtex/24f PTT RTFY | 12 | — | 15 (10) | ○ (Δ-X) | $3^{rd}$-$4^{th}$ ($2^{nd}$) | $4^{th}$ | ○ | 22 (27) | 159 |
| Ex. 37 | Cotton 16 count | 167 dtex/48f PTT RTFY | 14 | — | 21 (13) | ⊙ (Δ) | $4^{th}$ ($3^{rd}$-$4^{th}$) | $4^{th}$ | ⊙ | 32 (36) | 130 (0) |
| Ex. 38 | 133 dtex rayon twisted yarn | 167 dtex/48f PTT RTFY | 13 | — | 15 (9) | ⊙ (○) | $4^{th}$-$5^{th}$ ($3^{rd}$-$4^{th}$) | $4^{th}$ | ○ | 36 (39) | 119 (0) |
| C. E. 8 | 167 dtex/48f PET RTFY | 167 dtex/48f PET RTFY | 8 | 7 | 9 | X | $2^{nd}$ ($2^{nd}$) | $3^{rd}$ | X | 45 (47) | 46 (0) |

TABLE 2-continued

| | Structure of woven fabric | | Reduction (%) | Stretch ratio* | | Feel* | Wrinkle resistance* | Snagging | Comfortable feeling to wearer | Surface roughness* | Number of microcraters* |
|---|---|---|---|---|---|---|---|---|---|---|---|
| | Warp yarn | Weft yarn | | Warp direction | Weft direction | | | | | | |
| C. E. 9 | 167 dtex/48f PET RTFY | 167 dtex/48f PET RTFY | 35 | 8 | 12 | ○ | 3rd-4th (2nd) | 2nd | Δ | 38 (47) | 380 (0) |

Note:
RTFY: a yarn (reverse twisted false-twisted yarn with additional twist) prepared by false twisting a multifilamentary yarn, and then imparting additional twisting to the yarn in the direction reverse to the false twisting direction
*A value or grade in parentheses indicates a value or grade obtained when the sample was not subjected to reduction.

Note: RTFY: a yarn (reverse twisted false-twisted yarn with additional twist) prepared by false twisting a multifilamentary yarn, and then imparting additional twisting to the yarn in the direction reverse to the false twisting direction

*A value or grade in parentheses indicates a value or grade obtained when the sample was not subjected to reduction.

INDUSTRIAL APPLICABILITY

The woven fabric of the present invention has one or at least two of the following characteristics: excellent surface flatness; a soft feel; an excellent wrinkle resistance; and a comfortable feeling to the wearer. The fabric provides an excellent fitting feeling, has a light stretching function, and is excellent in weathering resistance and wash-and-wear properties (W & W properties). Accordingly, the fabric is useful as a stretch material for sportswear, outerwear, and the like.

What is claimed is:

1. A stretchable woven fabric comprising a woven fabric of a warn yarn and a weft yarn, the warp yarn and/or the weft yarn being prepared from a false-twisted yarn of a poly (trimethylene terephthalate) multifilamentary yarn, wherein the false-twisted yarn is twisted with a twist factor of from 2,700 to 13,000 in a direction reverse to the false twisting direction.

2. The stretchable woven fabric according to claim 1, wherein a stretch ratio of the woven fabric is from 15 to 50% in the warp and/or weft direction.

3. The stretchable woven fabric according to claim 1, wherein a stretch ratio of the woven fabric is greater than 20% and 50% or less in the warp and/or weft direction.

4. The stretchable woven fabric according to any one of claims 1 to 3, wherein a surface roughness ($R_a$) of the woven fabric is from 10 to 30 $\mu$m.

5. The stretchable woven fabric according to claim 1, wherein filaments of the poly(trimethylene terephthalate) multifilamentary yarn have microcraters on the surface.

6. A stretchable woven fabric comprising a woven fabric of a warp yarn and a weft yarn, the warp yarn and/or the weft yarn being prepared from a false-twisted yarn of a poly (trimethylene terephthalate) multifilamentary yarn, wherein a stretch ratio of the woven fabric is 15% or more in the warp and/or weft direction, and a surface roughness ($R_a$) of the woven fabric is from 10 to 30 $\mu$m.

7. The stretchable woven fabric according to claim 6, wherein the stretch ratio of the woven fabric is greater than 20% and 50% or less in the warp and/or weft direction.

8. The stretchable woven fabric according to claim 1 or 6, wherein the weave texture of the woven fabric is a 2/2 weft ribbed weave, a 2/1 twill weave or a 2/2 twill weave.

9. A process for producing a stretchable woven fabric comprising the steps of: twisting a poly(trimethylene terephthalate) multifilamentary yarn prior to or subsequent to false twisting with a twist factor of from 2,700 to 13,000 in a direction reverse to the false twisting direction, whereby a textured yarn is obtained; weaving the textured yarn as a warp yarn and/or a weft yarn into a woven fabric; and subjecting the woven fabric to alkali reduction.

10. The process for producing a stretchable woven fabric according to claim 9, wherein the alkali reduction ratio is from 4 to 15% by weight.

11. A process for producing a stretchable woven fabric comprising the steps of: false twisting a poly(trimethylene terephthalate) multifilamentary yarn; imparting additional twisting to the false-twisted yarn in a direction reverse to the false twisting direction, whereby a textured yarn having a twist factor of additional twist of from 2,700 to 13,000 is obtained; and weaving the textured yarn as a warp yarn and/or a weft yarn into a woven fabric so that a stretch ratio of the woven fabric is adjusted to from 15 to 50% in the warp and/or weft direction.

* * * * *

UNITED STATES PATENT AND TRADEMARK OFFICE

CERTIFICATE OF CORRECTION

PATENT NO. : 6,705,353 B2
DATED : March 16, 2004
INVENTOR(S) : Yoshiomi Hotta et al.

It is certified that error appears in the above-identified patent and that said Letters Patent is hereby corrected as shown below:

Column 33,
Line 39, "of a warn yarn" should read -- of a warp yarn --.

Signed and Sealed this

Twenty-first Day of September, 2004

JON W. DUDAS
*Director of the United States Patent and Trademark Office*